US009128417B2

(12) United States Patent
Yamasaki et al.

(10) Patent No.: US 9,128,417 B2
(45) Date of Patent: Sep. 8, 2015

(54) UNIT AND IMAGE FORMING APPARATUS

(71) Applicant: CANON KABUSHIKI KAISHA, Tokyo (JP)

(72) Inventors: Toshiteru Yamasaki, Yokohama (JP); Kohichi Takahashi, Yokohama (JP); Fumito Nonaka, Mishima (JP); Yuuki Nakamura, Mishima (JP); Naoki Hayashi, Kawasaki (JP); Toshiki Fujino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 14/018,474

(22) Filed: Sep. 5, 2013

(65) Prior Publication Data

US 2014/0064776 A1 Mar. 6, 2014

(30) Foreign Application Priority Data

Sep. 6, 2012 (JP) ..... 2012-196377
Aug. 20, 2013 (JP) ..... 2013-170576

(51) Int. Cl.
*G03G 15/00* (2006.01)
*G03G 21/00* (2006.01)
*G03G 15/08* (2006.01)

(52) U.S. Cl.
CPC ..... *G03G 15/0898* (2013.01)

(58) Field of Classification Search
CPC ..... G03G 15/0898; G03G 15/0817; G03G 15/0812; G03G 21/1832; G03G 15/0881; B65D 47/04
USPC ..... 399/102, 103, 106, 107, 111, 119
See application file for complete search history.

(56) References Cited

U.S. PATENT DOCUMENTS

| | | | |
|---|---|---|---|
| 5,884,124 | A | 3/1999 | Karakama et al. |
| 5,937,237 | A | 8/1999 | Nonaka et al. |
| 6,101,348 | A | 8/2000 | Nonaka et al. |
| 6,473,577 | B1 | 10/2002 | Higeta et al. |
| 6,826,380 | B2 | 11/2004 | Karakama et al. |
| 6,922,534 | B2 | 7/2005 | Goto et al. |
| 7,082,276 | B2 | 7/2006 | Karakama et al. |
| 7,865,115 | B2 | 1/2011 | Oguma et al. |
| 8,036,543 | B2 | 10/2011 | Yokomori et al. |
| 8,180,251 | B2 | 5/2012 | Nakamura et al. |

(Continued)

FOREIGN PATENT DOCUMENTS

| | | | |
|---|---|---|---|
| JP | 3231848 | B2 | 7/1994 |
| JP | 2001-125467 | B1 | 1/2001 |

(Continued)

*Primary Examiner* — Francis Gray
(74) *Attorney, Agent, or Firm* — Fitzpatrick, Cella, Harper & Scinto

(57) ABSTRACT

A unit for use with an image forming apparatus includes: a frame; a developer accommodating portion; a sheet member, contact to a rotatable member and provided on the frame along a longitudinal direction of the rotatable member; a first end portion seal member for preventing, at a longitudinal end portion, the developer from leaking out from between the frame and the rotatable member; and a second end portion seal member for preventing the developer from leaking out from among the first end portion seal member, the sheet member and the frame. The second end portion seal member is formed by injecting, on the frame, a resin material having an elastic modulus smaller than an elastic modulus of the frame so as to contact with the first end portion seal member and the sheet member.

30 Claims, 29 Drawing Sheets

(56) References Cited

U.S. PATENT DOCUMENTS

| | | | | |
|---|---|---|---|---|
| 8,275,283 | B2 | 9/2012 | Uneme et al. | |
| 8,326,178 | B2 | 12/2012 | Nakamura et al. | |
| 8,401,441 | B2 | 3/2013 | Uneme et al. | |
| 8,422,914 | B2 | 4/2013 | Hayashi et al. | |
| 2002/0064392 | A1* | 5/2002 | Miura et al. | 399/103 |
| 2006/0269317 | A1* | 11/2006 | Fukuta | 399/103 |
| 2009/0245851 | A1* | 10/2009 | Hoshi et al. | 399/103 |
| 2010/0054796 | A1 | 3/2010 | Nakamura et al. | |
| 2012/0183328 | A1 | 7/2012 | Nakamura et al. | |
| 2013/0121720 | A1* | 5/2013 | Hoshi et al. | 399/106 |
| 2013/0129375 | A1* | 5/2013 | Yamasaki et al. | 399/103 |
| 2013/0129378 | A1 | 5/2013 | Hoshi et al. | |
| 2013/0164029 | A1 | 6/2013 | Fukui et al. | |
| 2013/0177334 | A1 | 7/2013 | Nonaka et al. | |
| 2013/0209137 | A1 | 8/2013 | Hayashi et al. | |
| 2014/0064784 | A1 | 3/2014 | Hayashi et al. | |
| 2014/0072327 | A1 | 3/2014 | Hayashi et al. | |
| 2014/0086620 | A1 | 3/2014 | Takeuchi et al. | |
| 2014/0093270 | A1 | 4/2014 | Nonaka | |

FOREIGN PATENT DOCUMENTS

| | | | |
|---|---|---|---|
| JP | 2001-125470 | A | 5/2001 |
| JP | 2004-126003 | A | 4/2004 |
| JP | 2006-138990 | A | 6/2006 |
| JP | 2007-025345 | A | 2/2007 |

* cited by examiner (a)

(b)

(a)

(b)

(a)

(b)

(a)

(b)

UNIT AND IMAGE FORMING APPARATUS

FIELD OF THE INVENTION AND RELATED ART

The present invention relates to a unit and an image forming apparatus.

In the image forming apparatus for forming an image on a recording material by using an electrophotographic image forming process, a constitution including a process cartridge detachable mountable to a main assembly of the image forming apparatus has been known. The process cartridge is prepared by integrally assembling an electrophotographic photosensitive member and a process means acting on the electrophotographic photosensitive member into a unit, and the process means includes at least one of a charging means, a developing means end a cleaning means. According to the process cartridge of this type, maintenance of the image forming apparatus can be performed by a user himself (herself) without relying on a service person, so that, operativity can be remarkably improved. Therefore, the process cartridge system has been widely used in the electrophotographic image forming apparatus. Examples of the electrophotographic image forming apparatus may include an electrophotographic copying machine, an electrophotographic printer (laser beam printer, LED printer or the like), a facsimile machine and the like.

A conventional process cartridge will be described with reference to FIGS. 32 to 35. FIG. 32 is a schematic sectional view of the conventional process cartridge. FIG. 33 is a schematic view when an initial tension is applied to a receptor cheer 203, FIG. 34 is a schematic view showing a state change for illustrating deviation or each of interfaces among a cleaning container 201, a double-side tape 204 and the receptor sheet 203 when an environment is changed in the order of normal temperature (e.g., 23° C.), high temperature (e.g., 50° C.) and normal temperature (e.g., 23° C.). FIG. 35 is a schematic view for illustrating a state in which an edge of the receptor sheet 203 mounted on the cleaning container 201 is waved (undulated).

Generally, in the electrophotographic image forming apparatus, the following steps are repeated daring image formation. First, an electrostatic latent image is formed on an electrophotographic image bearing member (image bearing member 202) having a photosensitive layer at an outer peripheral surface. The electrostatic latent image is developed (visualized) as an image with a developer fed from the developing means via a toner container (developer accommodating portion) 300, a developing container 301 and a developer carrying member 302, and then the resultant image is transferred onto a transfer material (recording material or medium). Further, after an image forming process is ended, the developer and other deposited matters which remain on the surface of the image bearing member ere sufficiently removed by the cleaning means before start of a subsequent image forming process.

As an example of the cleaning means, there is a means constituted by a cleaning blade 205, the receptor sheet 203 and the cleaning container 201. The cleaning blade 205 is used for scraping off a toner remaining on the image bearing member 202, and the receptor sheet 203 is used for scooping (receiving) the scraped toner. These members 205 and 203 are provided in contact with the surface of the image bearing member 202. The cleaning container 201 is provided with a residual toner chamber (developer accommodating portion) 200 for storing the scooped residual toner. The receptor sheet 203 is formed of biaxially-oriented polyester and is applied onto the cleaning container 201 at a predetermined position (mounting surface) with the double-side tape 204. The receptor sheet 203 contacting the image bearing member 202 is required to be applied onto the cleaning container 201 with high accuracy without causing the waving or the like at its edge portion. This is because, in the case where the receptor sheet 203 is not applied with high accuracy, the edge of the receptor sheet 203 cannot completely contact intimately the surface of the image bearing member 202 and as a result, the developer scraped off by the cleaning blade 205 cannot be scooped with reliability (Japanese Patent No. 3231848). Further, in order to prevent the waving of the receptor sheet 203 at the edge portion, a tension is applied to the edge of the receptor sheer 203, so that the receptor sheet 203 is applied onto the cleaning container 201 so as to obtain an amount of curvature (initial tension amount) m (FIG. 33). Incidentally, image bearing member end portion seal members 206*a* and 206*b* and a charging roller 207 are provided.

Further, as an example of the developing means, there is a means including a developing blade unit 305 and a blowoff preventing sheet 303. The developing blade unit 305 is used for regulate a thickness of a layer of the developer carried on the developer carrying member 302 in an upstream side with respect to a rotational direction of the developer carrying member 302. The blowoff preventing sheet is used for preventing the blowoff (leakage) of tire developer from inside to outside of the developing container 301. These developing blade unit 305 and blowoff preventing sheet 303 are provided in contact with the surface of the developer carrying member 302. Further, the blowoff preventing sheet 303 is formed of biaxialy-oriented polyester and is applied onto the developing container 301 at a predetermined position (mounting surface) with a double-side tape 304. Also with respect to the blowoff preventing sheet 303, similarly as in the case of the receptor sheet 203 described above, there is a need to apply the blowoff preventing sheet 303 onto the developing container 301 with high reliability without causing the waving or the like at an edge portion. This is because, in the case where the blowoff preventing sheet 303 is not applied with high accuracy, the edge of the blowoff preventing sheet 303 cannot completely contact intimately the surface of the developer carrying member 302 and as a result, the developer in the developing container 301 is blown off from a gap therebetween. Further, similarly as in the case of the receptor sheet 203, in order to prevent the waving of the blowoff preventing sheet 303 at the edge portion, a tension is applied to the edge of the blowoff preventing sheet 303, so that the blowoff preventing sheet 303 is applied onto the developing container 301 so as to obtain an amount of curvature (initial tension amount). Incidentally, developer carrying member end portion seal members 306*a* and 306*b* are provided.

As described above, the receptor sheet 203 and the blowoff preventing sheet 303 (hereinafter, these sheets are referred to as a thin plate member) are applied onto the cleaning container 201 or the developing container 301 (hereinafter, these containers are referenced to as a frame) by using the double-side tapes. Further, their application positions are important since they largely affect developer leakage prevention from the frames. For this reason, there is a need to apply the doable-aide tape onto the frame with high accuracy in order to prevent the leakage of the developer, and the prevention of the waving of the thin plate member edge is important. The thin plate member is required to prevent the waving of the thin plate member edge with respect to a change in temperature (e.g., 0° C. to 50° C.) at a periphery of an associated cartridge in the image forming apparatus during rest (stop) and operation of the image forming apparatus.

For example, as shown in FIG. 34, in the case where the cartridge is left standing in the environment in the order of normal temperature (e.g., 23° C.), high temperature (e.g., 50° C.) and NT (e.g., 23° C.), each of the members is elongated corresponding to its linear expansion coefficient. In this case, the double-side tape 204 deviates (shifts) at an interface thereof with each of the cleaning container 201 and the receptor sheet 203, thus absorbing a difference in elongation between the cleaning container 201 and the receptor sheet 203. Further, in some cases, the deviation cannot be restored to an original state when the temperature is returned to the normal temperature and remains as y1 and y2. At this time, in the case where the amount of curvature (initial tension amount) m is insufficient, the curvature amount m becomes small, so that waving W as shown in FIG. 35 is generated in some cases.

Further, with reference to FIGS. 36 to 38, a structure of end portion seal members 406*a* and 406*b* will be described.

FIG. 36 is a schematic sectional view of a conventional process cartridge. Part (a) of FIG. 37 is a schematic front view showing a positional relationship among a receptor sheet 403, an image bearing member end portion seal member 406*a* and a cleaning container 401. Part (b) of FIG. 37 is a sectional view before application of a hot melt 407. Part (c) of FIG. 37 is a sectional view after the application of the hot melt 407. Part (a) of FIG. 38 is a schematic front view showing a positional relationship among a blowoff preventing sheet 303, a developer carrying member end portion seal member 500*a* and a developing container 501. Part (b) of FIG. 38 is a sectional view before application of a hot melt 507. Part (c) of FIG. 38 is a sectional view after the application of the hot melt 507.

In an electrophotographic image forming apparatus, the following steps are repeated during image formation. Description will be made with reference to FIG. 36.

First, an electrostatic latent image is formed on an electrophotographic image bearing member (image bearing member 402) having a photosensitive laser at an outer peripheral surface. The electrostatic latent image is developed (visualized) as an image with a developer fed from the developing means via a toner container (developer accommodating portion) 500, a developing container 501 and a developer carrying member 502, and then the resultant image is transferred, onto a transfer material (recording material). Further, after an image forming process is ended, the developer and other deposited matters which remain on the surface of the image bearing member are sufficiently removed by the cleaning means before start of a subsequent image forming process.

With reference to FIG. 37, the cleaning means when the process cartridge of FIG. 36 is viewed from an arrow M direction in the figure will be described. As the cleaning means, there has been known a means constituted by a cleaning blade 405, a receptor sheet 403, image bearing member end portion seal members 406*a* and 406*b* (not shown in FIG. 37), and a cleaning container 401. The cleaning blade 405 scraps off a toner remaining on the image bearing member 402, and the receptor sheet 403 scoops (receives) the scraped, toner. The image bearing member end portion seal member 406*a* is provided at an end of an end portion in order to prevent the scraped toner from leaking out from an outer peripheral surface of an end portion of the image bearing member 402, and the image bearing member end portion seal member 406*b* (not shown) is provided at another end. The cleaning container 401 includes a residual (waste) toner chamber 400.

Here, the cleaning blade 405 and the receptor sheer 403 are provided in contact with the surface of the image bearing member 402. Further, the image bearing member end portion seal members 406*a* and 406*b* are disposed on the basis of the cleaning blade 405, and are contacted to the receptor sheet 403 at end portions of the receptor sheet 403 and are also contacted so the outer peripheral surface of the image bearing member 402. At this time, there is a need to seal a gap i1 between the cleaning container 401 and the image bearing member end portion seal member 406*a* (406*b*) with respect to a thickness direction of the image bearing member end portion seal member 406*a* (406*b*) or a gap i2 between the cleaning container 401 and the receptor sheet 403. This is because these gaps cause the leaking-out of the toner. Therefore, the gaps i1 and i2 are sealed, by applying a resin material, such as the hot melt 407 or the like later (Japanese Laid-Open Patent Application (JP-A) 2004-126003). Further, in order to decrease the gap i2 between the cleaning container 401 and the receptor sheet 403, a double-side tape 404 is applied therebetween with high accuracy.

Further, with reference to FIG. 38, the developing means when the process cartridge of FIG. 36 is viewed from an arrow N direction in the figure will be described. As the developing means, there has been known a means constituted by developing blade unit 505 developer carrying member end portion seal members 306*a* and 506*b* (not shown in FIG. 38), and a blowoff preventing sheet 503. The developer blade unit 505 is provided upstream of the developer carrying member 502 with respect to a rotational direction of the developer carrying member 502 and regulates a layer thickness of the developer carried on the developer carrying member 502. The developer carrying member end portion seal member 506*a* is provided at an end of an end portion in order to prevent the toner from leaking out from an outer peripheral surface of an end portion of the developer carrying member 502, and the developer carrying member end portion seal member 506*b* (not shown) is provided at another end. The blowoff preventing sheet 503 is provided downstream of the developer carrying member 502 with respect to the rotational direction of the developer carrying member 502 and prevents the toner from blowing off (leaking out) from the inside the outer side of the developing container 501.

The developing blade unit 505 and the blowoff preventing sheet 503 are provided in contact with the surface of the developer carrying member 502. Further, the developer carrying member end portion seal members 506*a* and 506*b* are contacted to the blowoff preventing sheet 503 at end portions of the blowoff preventing sheet 503 and are also contacted to the outer peripheral surface of the developer carrying member 502. At this time, similarly as in the above-described cleaning means, a gap s1 between the developing container 501 and the developer carrying member end portion seal member 506*a* (506*b*) with respect to a thickness direction of the developer carrying member end portion seal member 506*a* (506*b*) or a gap s2 between the developing container 501 and the blowoff preventing sheet 503 are not sealed, these gaps cause the leaking-out of the toner. Therefore, the gaps s1 and s2 are sealed by applying a resin material such as the hot melt 507 or the like later. Further, in order to decrease the gap s2 between the process cartridge 501 and the blowoff preventing sheet 503, a double-side tape 504 is applied therebetween with high accuracy.

As described above, it is important to seal (decrease) the gap between the cleaning container 401 (frame) and the image bearing member end portion seal member 406*a* (406*b*) and the gap between the developing container 501 (frame) and the developer carrying member end portion seal member 506*a* (506*b*). Further, it is also important to seal (decrease) the gap between the frame and the receptor sheet 403 (sheet member) and the gap between the frame and the blowoff preventing sheet 503 (sheet member). The sealing of these gaps largely affects the prevention of the leaking-out of the toner from the frame. For this reason, in order to prevent the toner leaking-out, there is a need to apply another resin material, such as the hot melt 407 (507), to the gap between the frame and the end portion seal member later or a need to bond the double-side tape 404 (504) in the neighborhood of the end portion seal member.

In recent years, in a cartridge assembling step by an automatic machine, in order to further reduce a cost, improvements in manufacturing efficiency and product manufacturing accuracy are required. Further, with improvements in performance and image quality of the electrophotographic image forming apparatus, downsizing of the cartridge is required. However, in the above-described bonding (application) method in which the thin plate member is applied onto the frame with the double-side tape, the following problems arose. The double-side tape is soft and therefore when a width of the double-side tape is made small for she purposes of the cost reduction and the downsizing of the cartridge, meandering of the double-side tape is generated and thus it is difficult to apply the thin plate member onto the cartridge frame with high accuracy. Further, after the cartridge is left standing in the high temperature environment, the deviation is generated at the interface between the double-side tape and the thin plate member and at the interface between the double-side tape and the cartridge frame and thus the curvature amount m is decreased, so that the initial tension of the thin plate member is attenuated. For that reason, there was a need to control the tension amount of the thin plate member edge in consideration of the initial tension attenuation.

Further, in order to apply the hot melt to the gap between the frame and the send portion seal member and the gap between the frame and the sheet member, there was need to ensure a space (such as an application opening) and to perform an inspecting step of inspecting an application state.

SUMMARY OF THE INVENTION

A principal object of the present invention is to provide a unit and an image forming apparatus which are capsule of reliably prevent leaking-out of a toner from between an end portion seal member of the unit and a sheet member contacting a rotatable member.

According to an aspect of the present invention, there is a unit for use with an image terming apparatus, comprising: a frame; a developer accommodating portion, constituted the frame, for accommodating a developer; a sheet member, contact to a rotatable member and provided on the frame along a longitudinal direction of the rotatable member, for preventing a developer from leaking out from between the frame and the rotatable member; a first end portion seal member for preventing, at a longitudinal end portion, the developer from leaking out from between the frame and the rotatable member; and a second end portion seal member for preventing the developer from leaking out from among the first end portion seal member, the sheet member and the frame, wherein the second end portion seal member is formed by injecting, on the frame, a resin material having an elastic modulus smaller than an elastic modulus of the frame so as to contact with the first end portion seal member and the sheet member.

According to another aspect of the present invention, there is provided an image forming apparatus for forming image on a recording material, comprising: a frame; a developer accommodating portion, constituted by the frame, for accommodating a developer; a sheet member, contact to a rotatable member and provided on the frame along a longitudinal direction of the rotatable member, for preventing a developer from leaking out from between the frame and the rotatable member; a first end portion seal member for preventing, at a longitudinal end portion, the developer from leaking out from between the frame and the rotatable member; and a second end portion seal member for preventing the developer from leaking out from among the first end portion seal member, the sheet member and the frame, wherein the second end portion seal member is formed by injecting, on the frame, a resin material having an elastic modulus smaller than an elastic modulus of the frame so as to contact with the first, end portion seal member and the sheet member.

These and other objects, features and advantages of the present invention will become more apparent upon a consideration of the following description of the preferred embodiments of the present invention taken in conjunction with the accompanying drawings.

Figure 9:
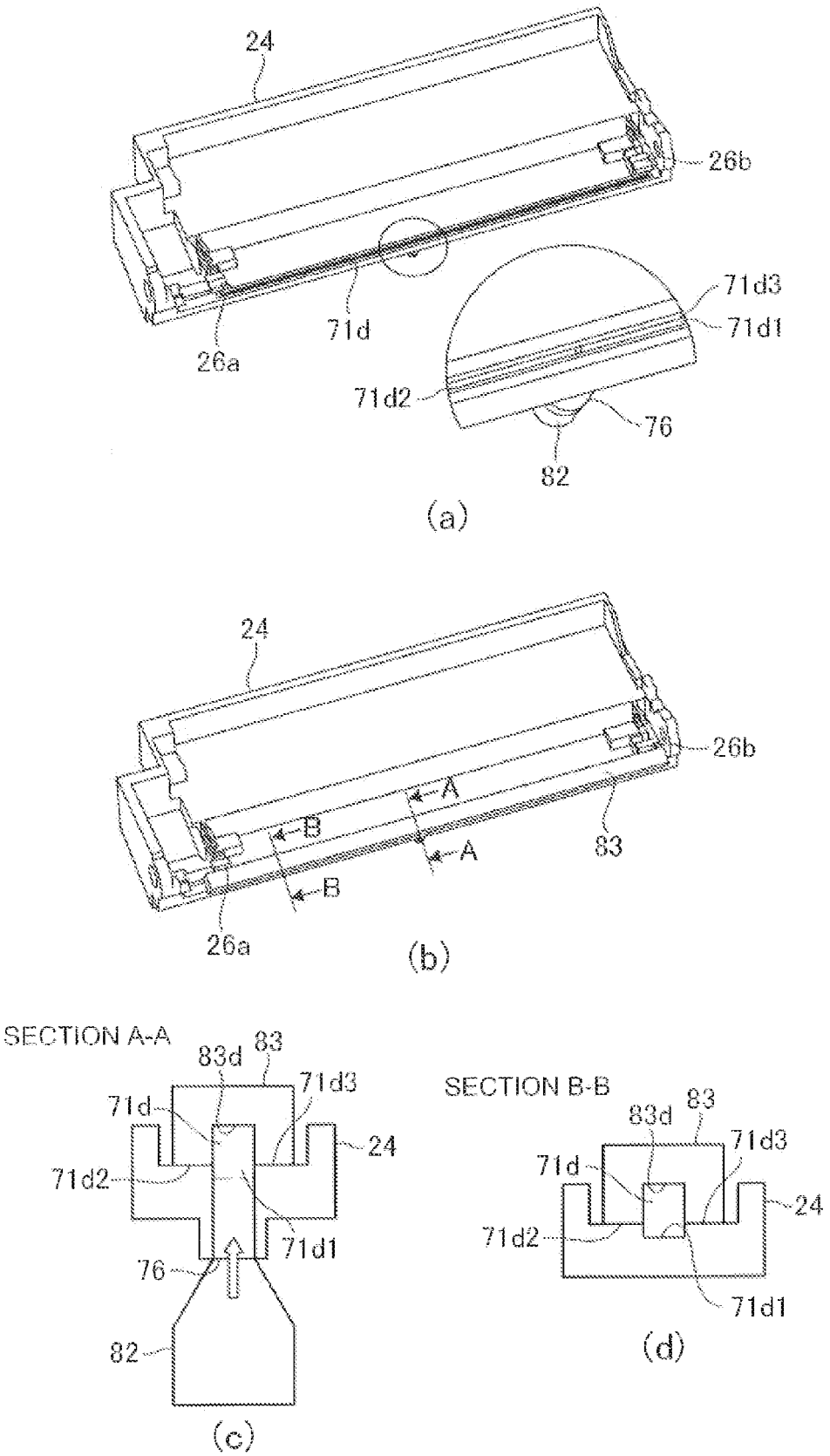

Parts (a) to (d) of FIG. 9 are schematic views for illustrating molding of an elastomer member.

Figure 10:
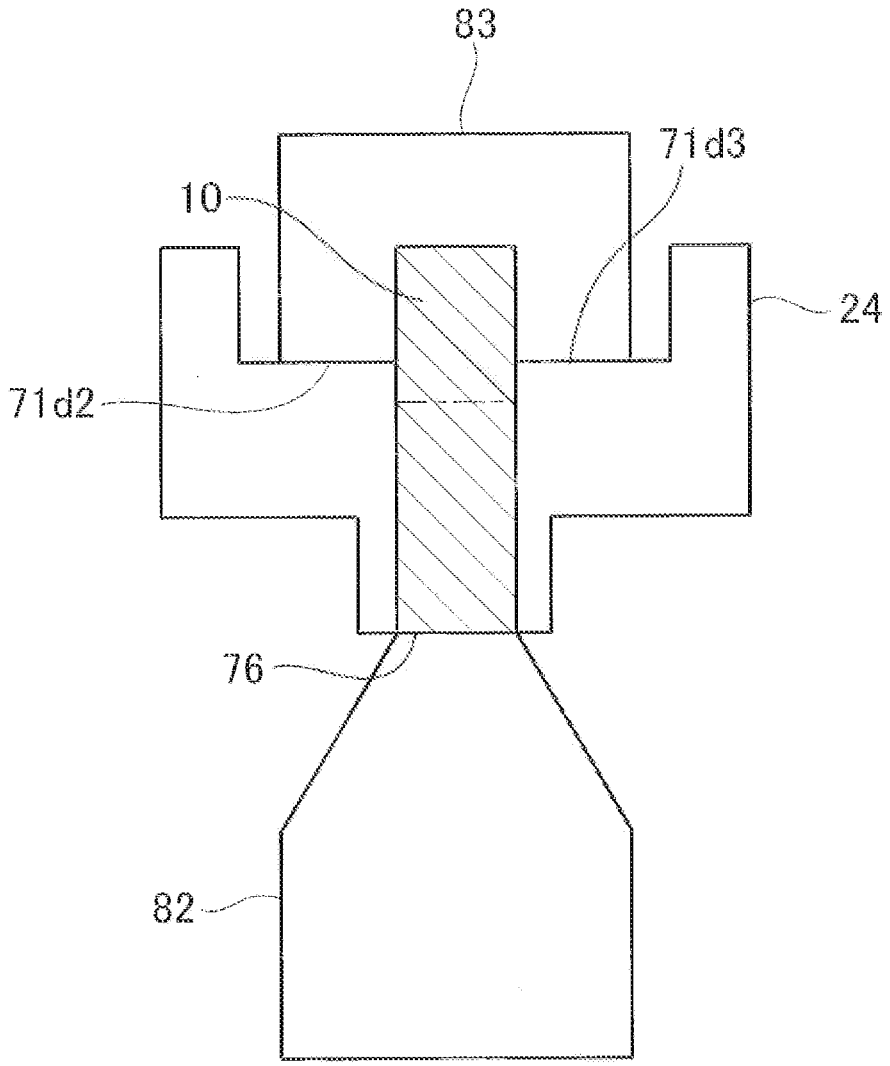

FIG. 10 is a schematic sectional view for illustrating the molding of the elastomer member taken along A-A line indicated in (b) of FIG. 9.

Figure 11:
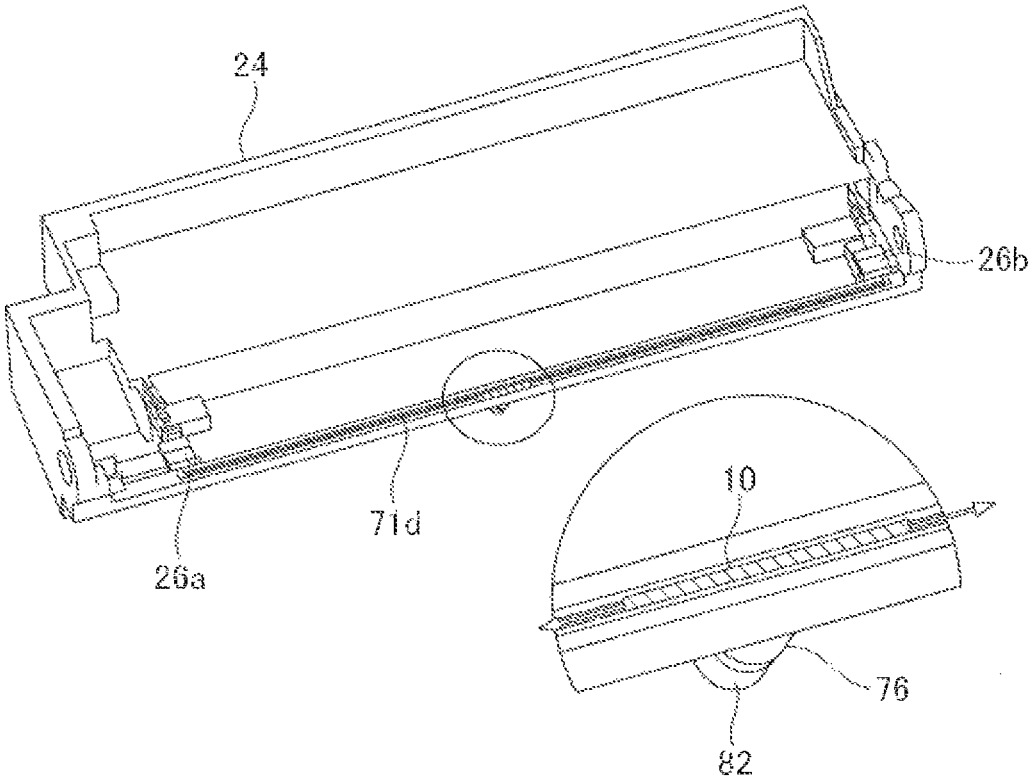

FIG. 11 is a schematic view showing a state of the elastomer member during the molding.

Parts (a) and (b) of each of FIGS. 12 to 17 are structural illustrations showing molded shapes 1 to 6, respectively, of the elastomer member.

Figure 18:
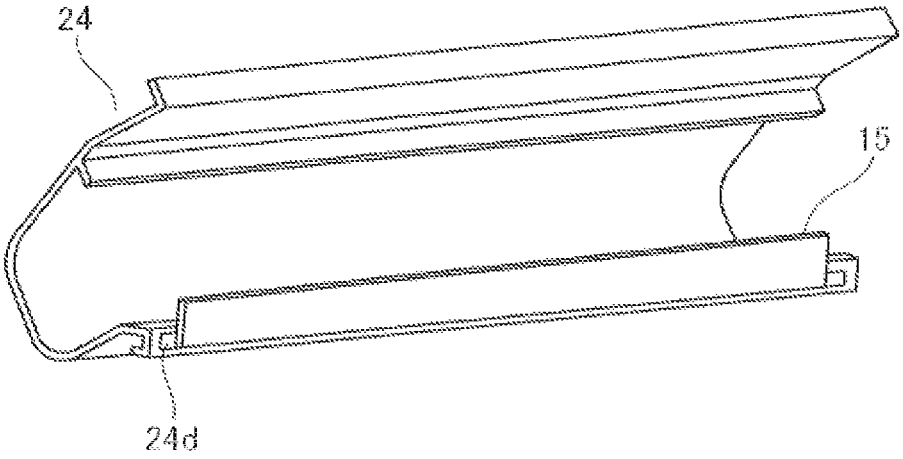
Figure 18:
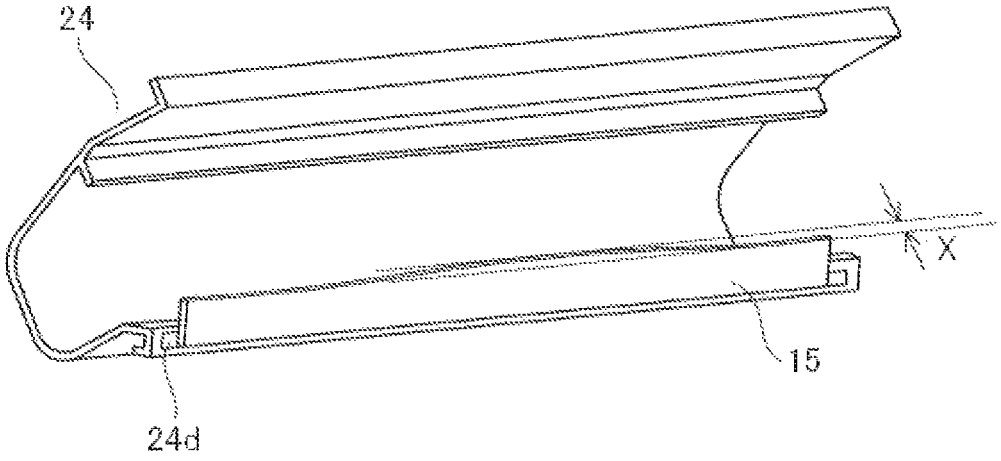

Parts (a) and (b) of FIG. 18 are schematic illustrations of a cleaning container on which a receptor sheet is mounted.

Figure 19:
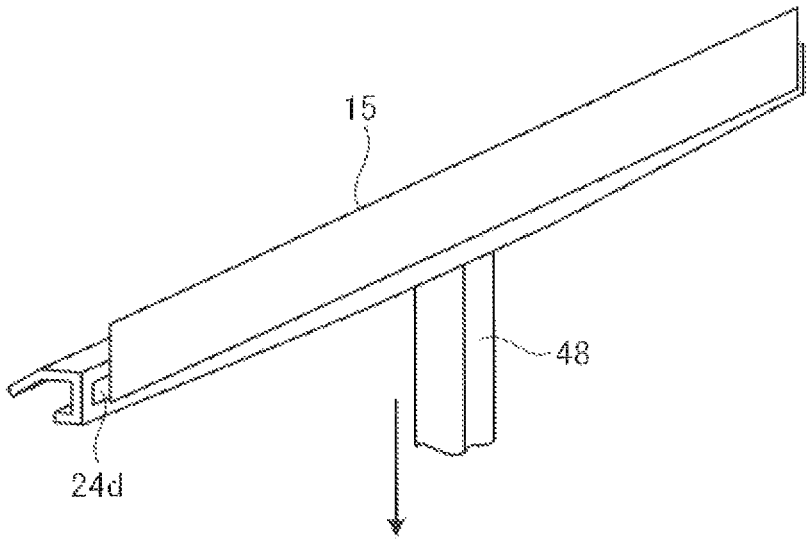
Figure 19:
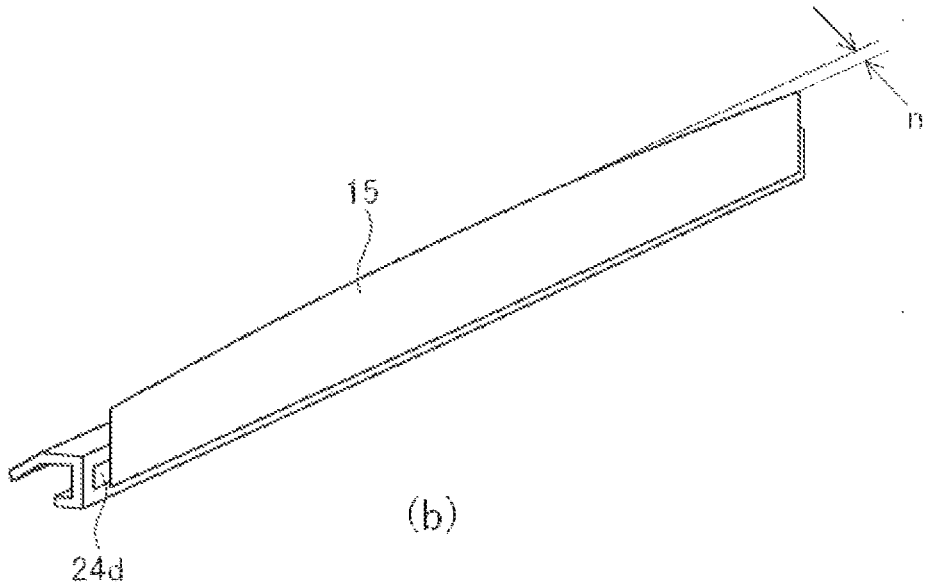

Parts (a) and (b) of FIG. 19 are schematic views for illustrating a method of applying tension to an upper edge of the receptor sheet.

Figure 20:
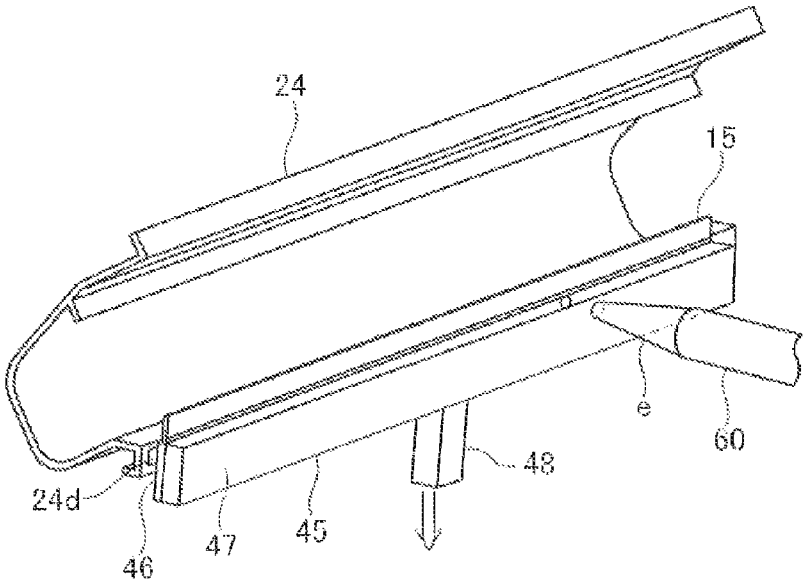

FIG. 20 is an illustration showing a state in which the elastomer member is melted to weld a sheet.

Figure 21:
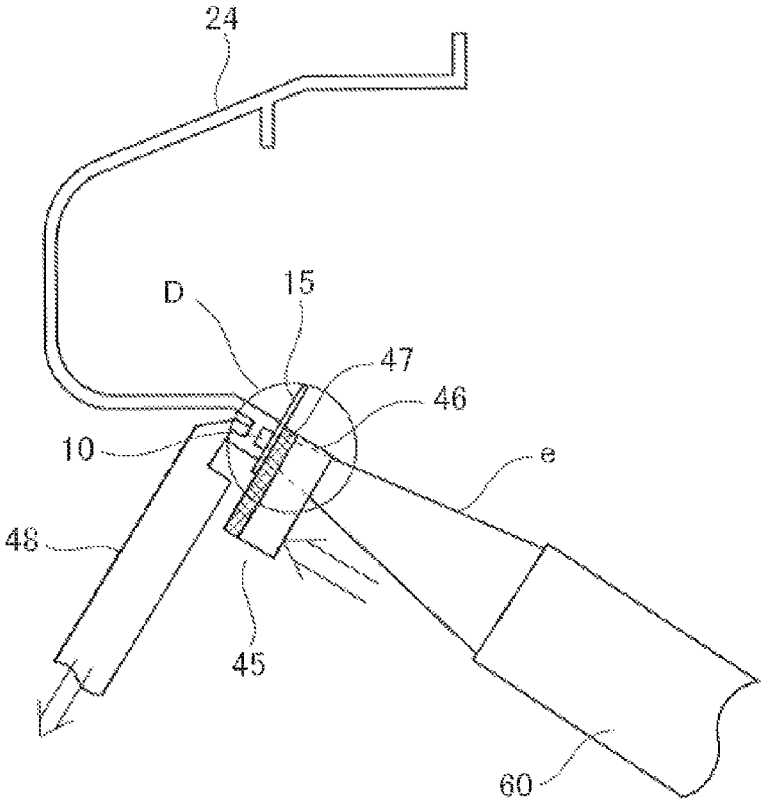

FIG. 21 is a schematic sectional view showing the state in FIG. 20.

Figure 22:
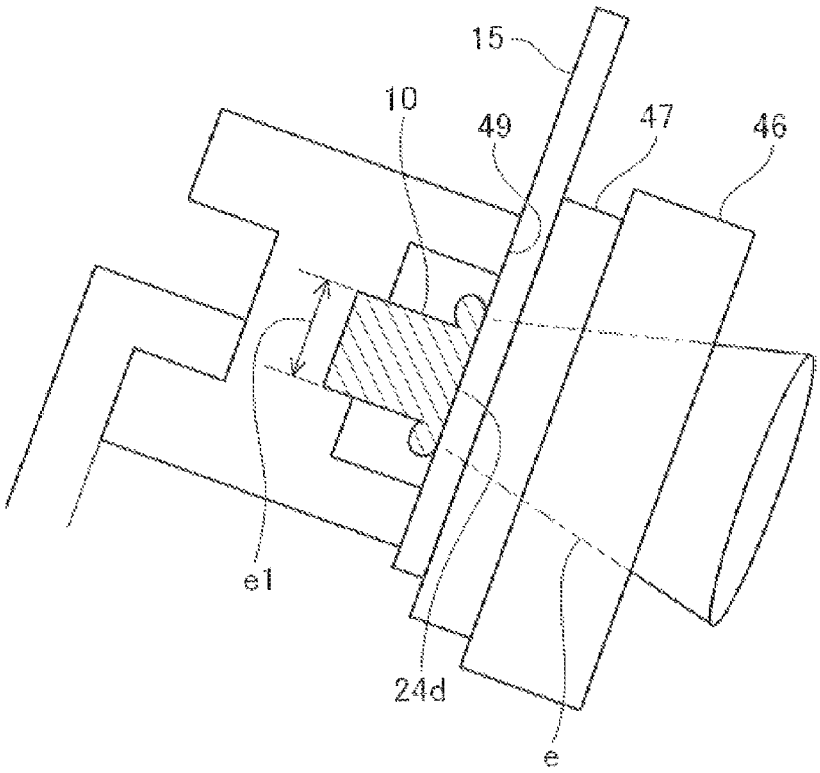

FIG. 22 is an enlarged view of D portion indicated in FIG. 21.

Figure 23:
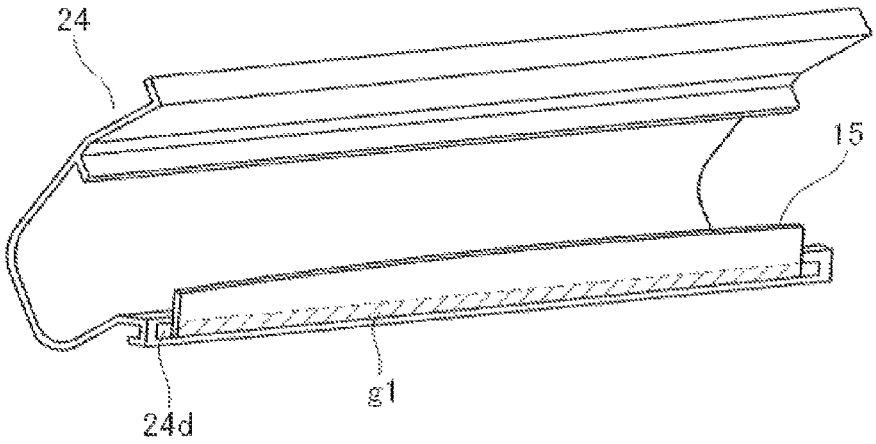

FIG. 23 is an illustration showing the cleaning container on which the receptor sheet is welded.

Figure 24:
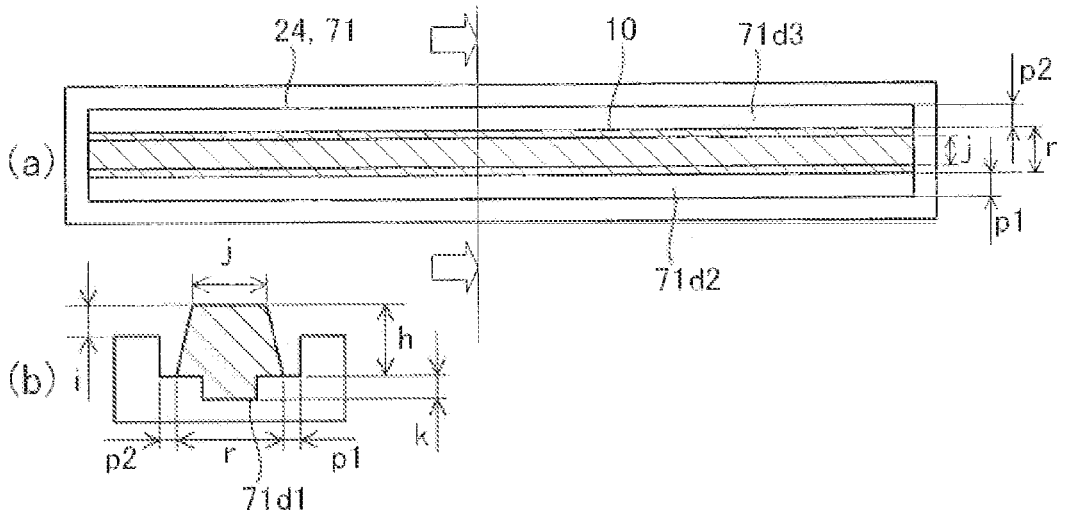

Parts (a) and (b) of FIG. 24 are schematic front and sectional views, respectively, showing a molded shape of the elastomer member.

Figure 25:
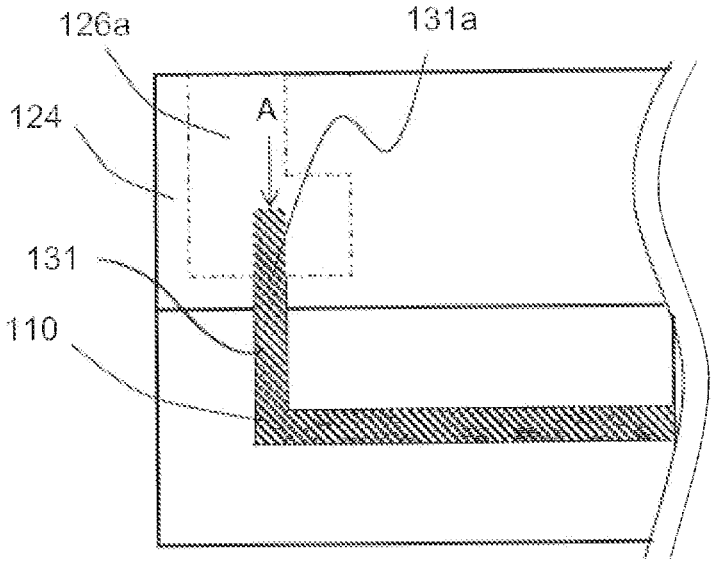
Figure 25:
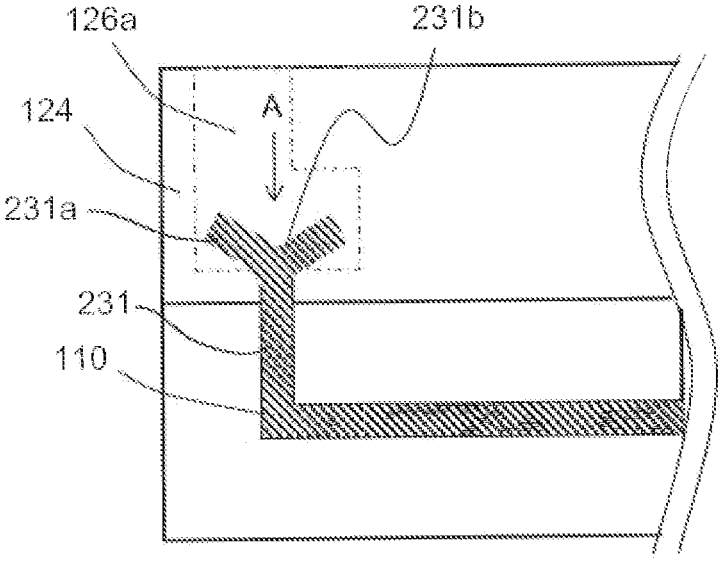

Parts (a) and (b) of FIG. 25 are schematic views during molding of a sealing portion of the cleaning container.

Figure 26:
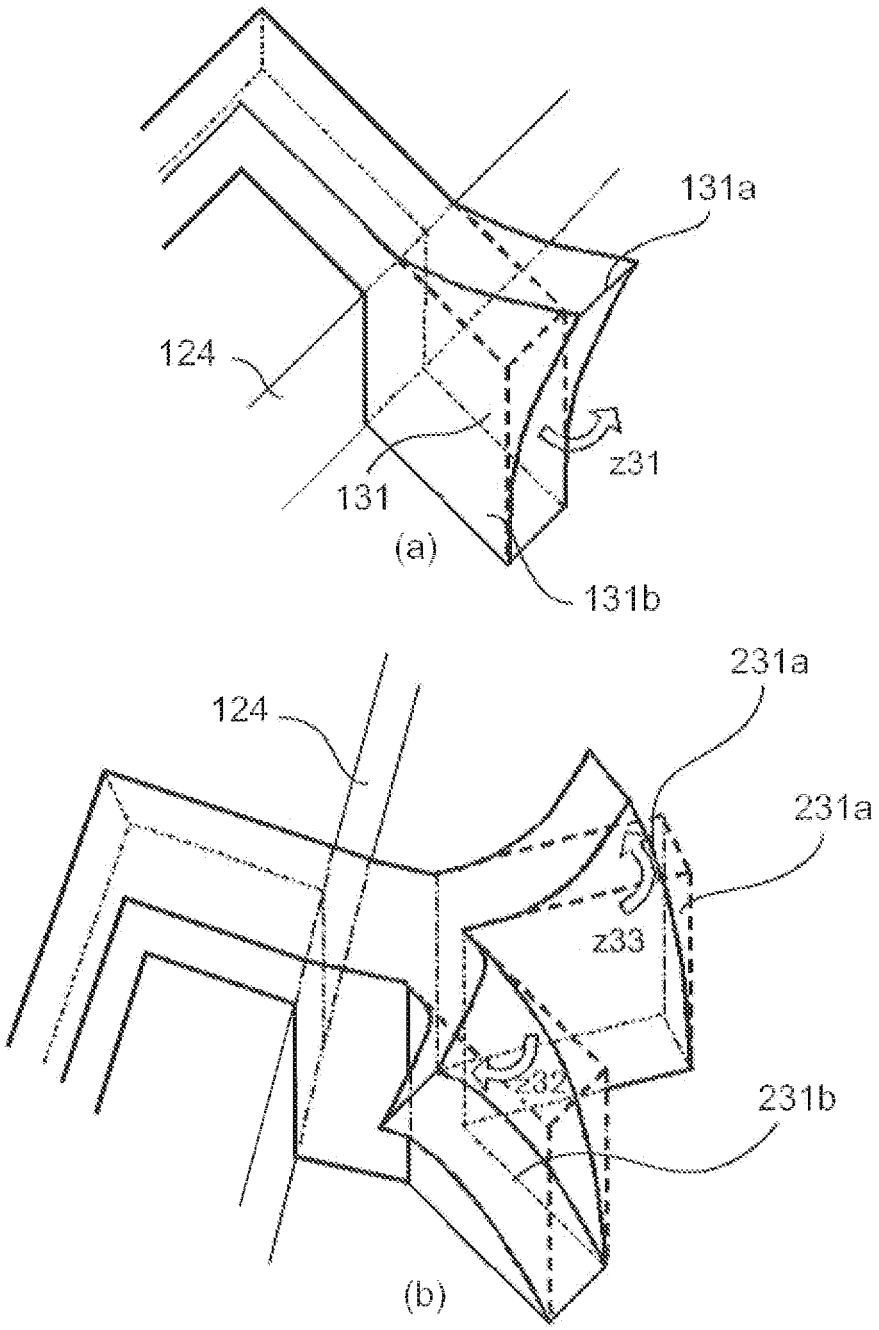

Parts (a) and (b) of FIG. 26 are illustrations showing state in which the sealing portion is flexed.

Figure 27:
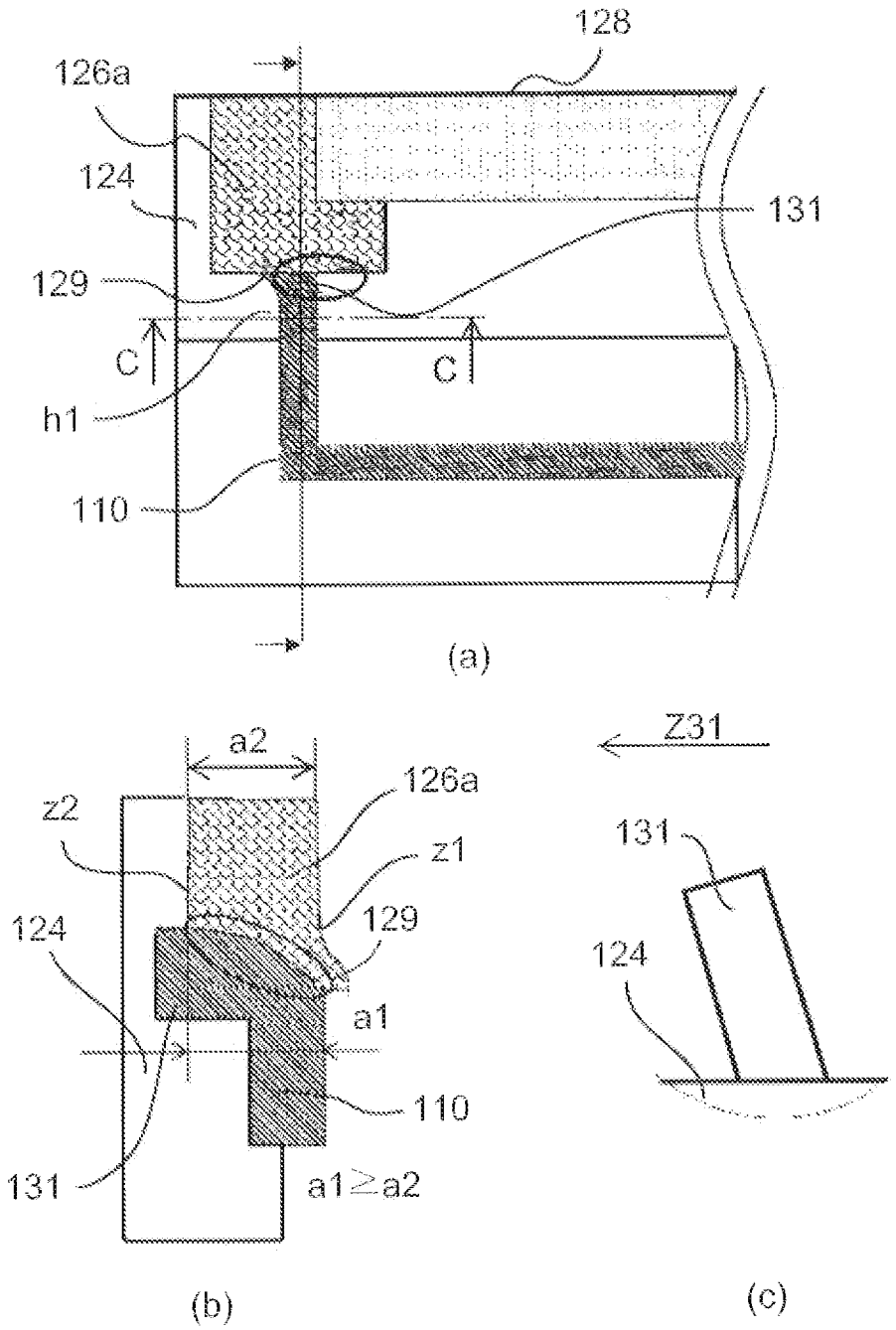

Parts (a) to (c) of FIG. 27 are illustrations showing a state of an end portion seal member and the sealing portion during mounting of the end portion seal member.

Figure 28:
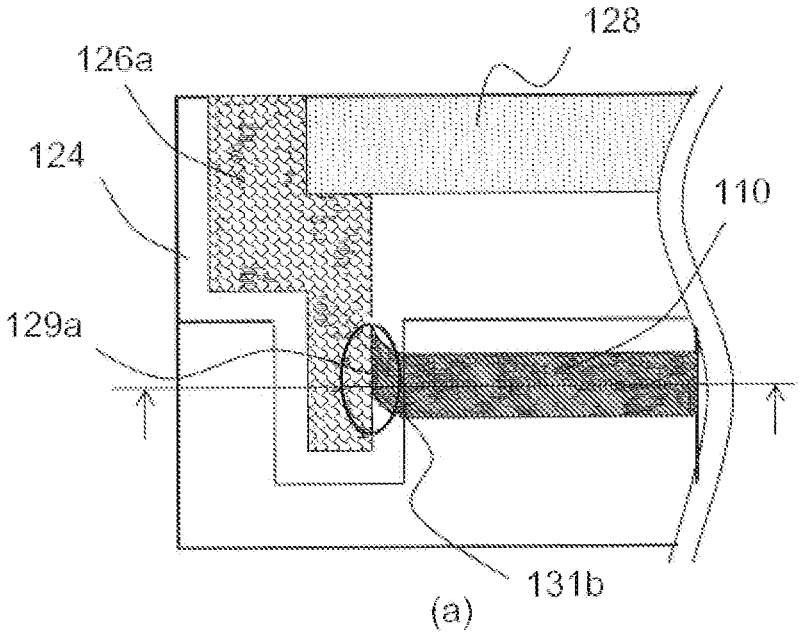
Figure 28:
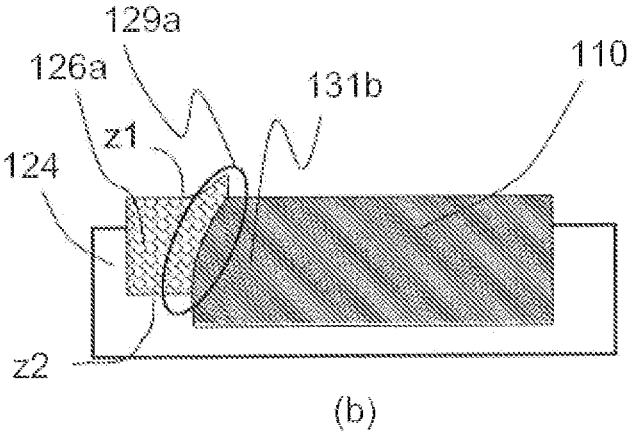

Parts (a) and (b) of FIG. 28 are illustrations showing a state of the end portion seal member and the sealing portion when a position of the end portion seal member is changed.

Figure 29:
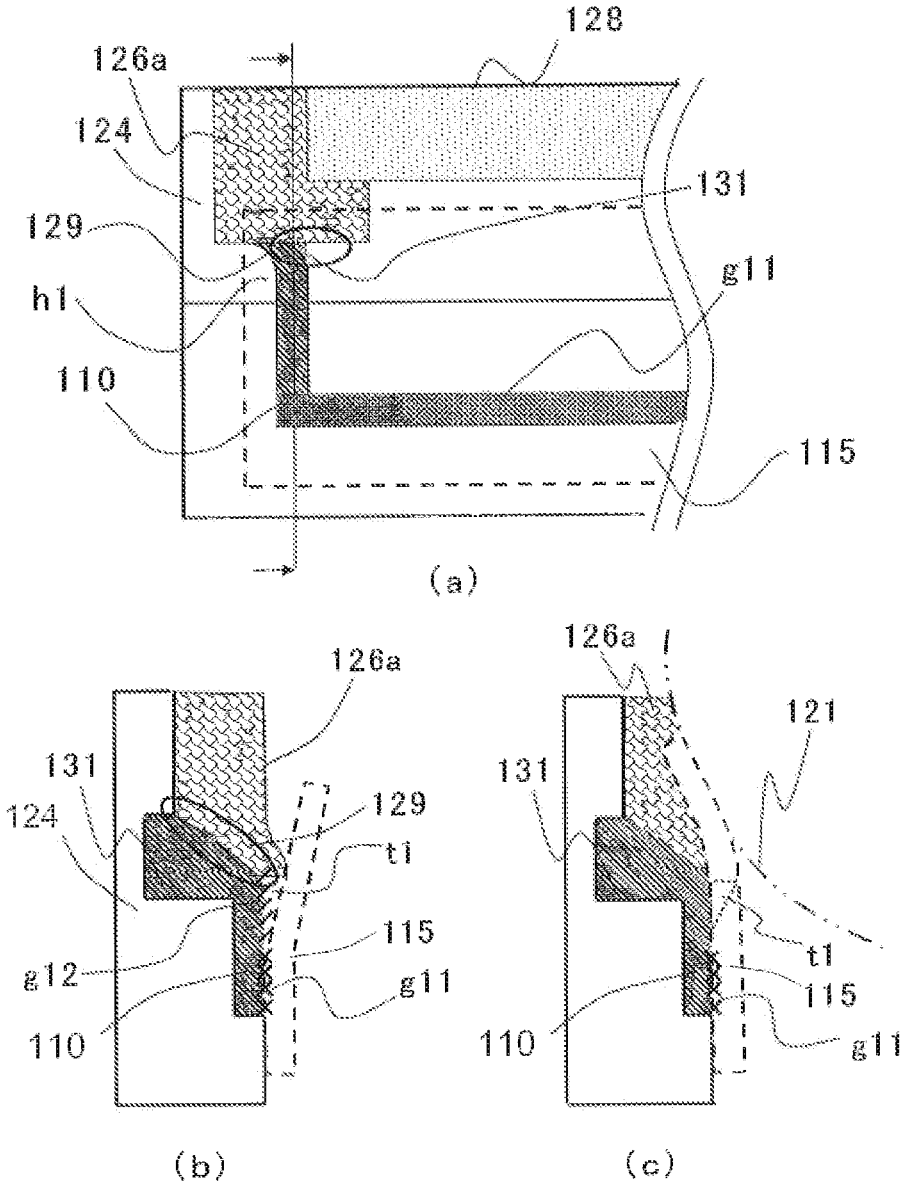

Part (a) of FIG. 22 is a schematic front view showing a receptor sheet application state at an end portion, and (b) and (c) of FIG. 29 are schematic sectional views showing the receptor sheet application state.

Figure 30:
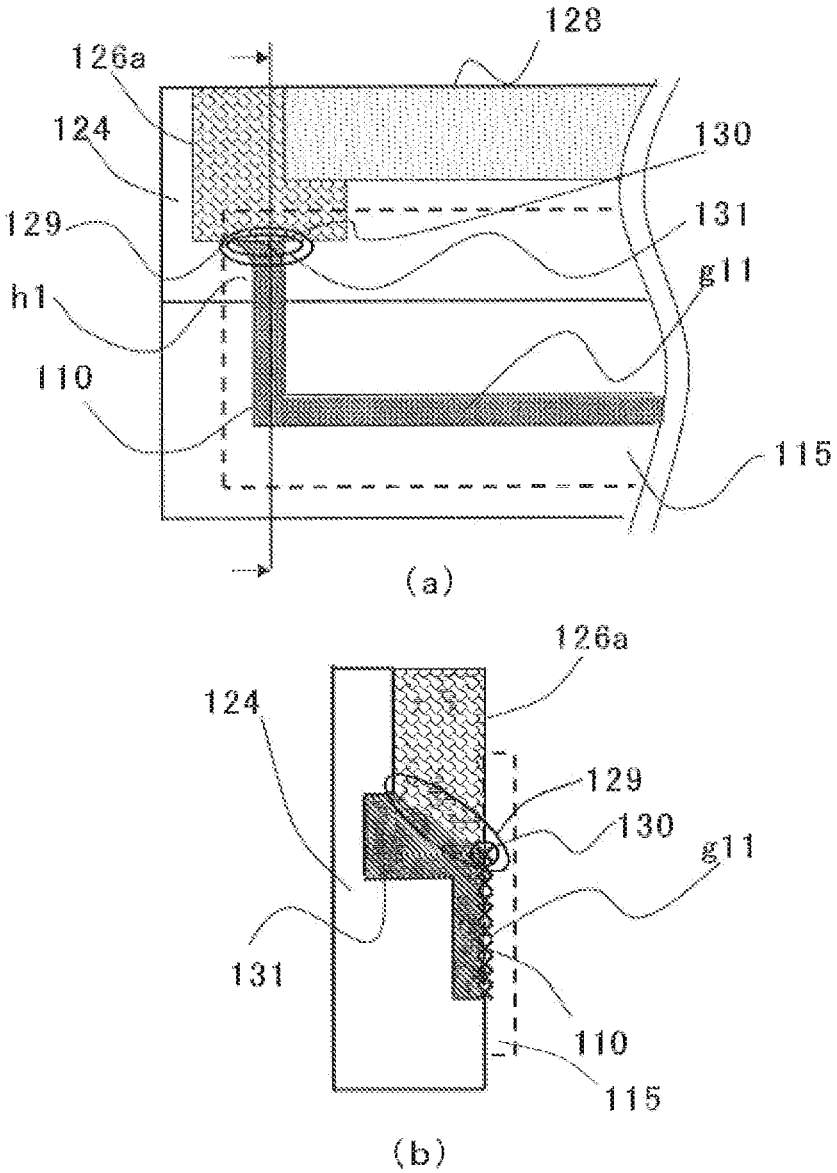

Parts (a) and (b) of FIG. 30 are schematic from and sectional views, respectively, showing the receptor sheet application state when a welded state is changed.

Figure 31:
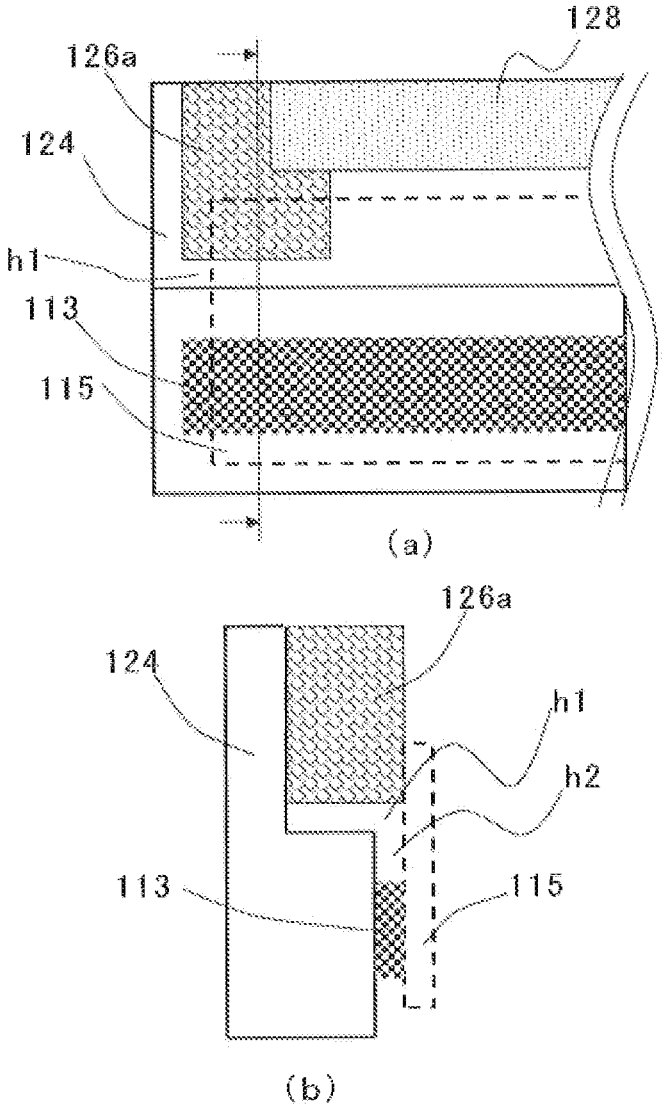

Parts (a) and (b) of FIG. 31 are schematic front and sectional views, respectively, showing a receptor sheet application state at an end portion in a conventional constitution.

Figure 32:
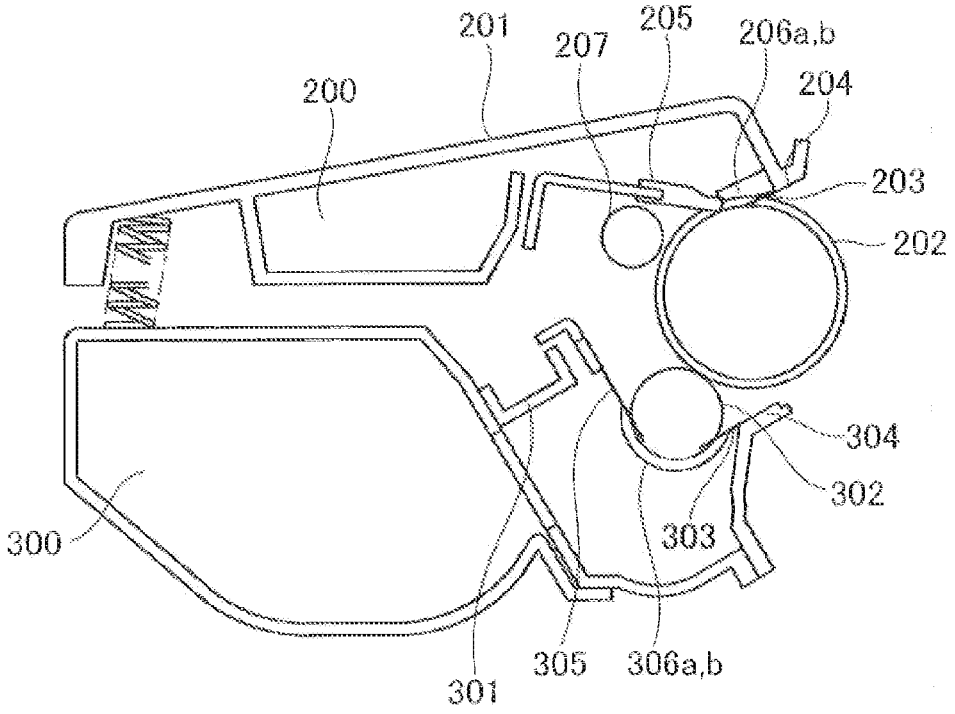

FIG. 32 is a schematic sectional view of a conventional process cartridge.

Figure 33:
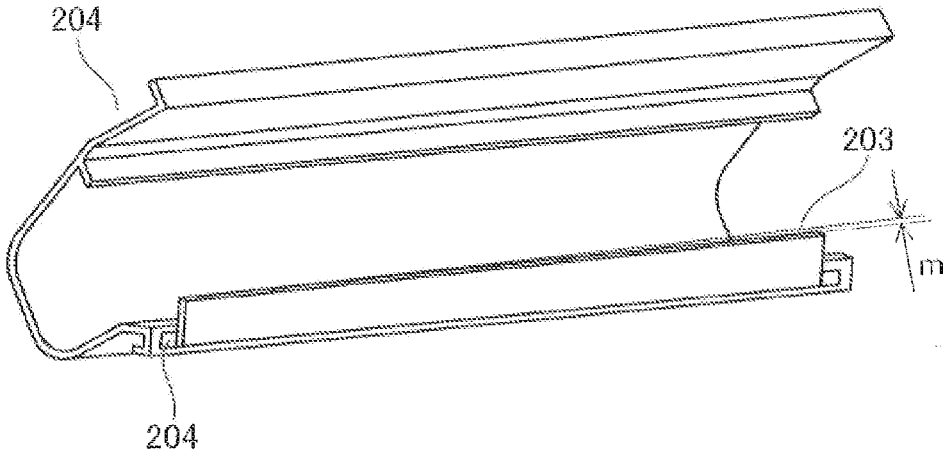

FIG. 33 is a schematic view showing a cleaning container and a receptor sheet when initial tension is applied to the receptor sheet.

Figure 34:
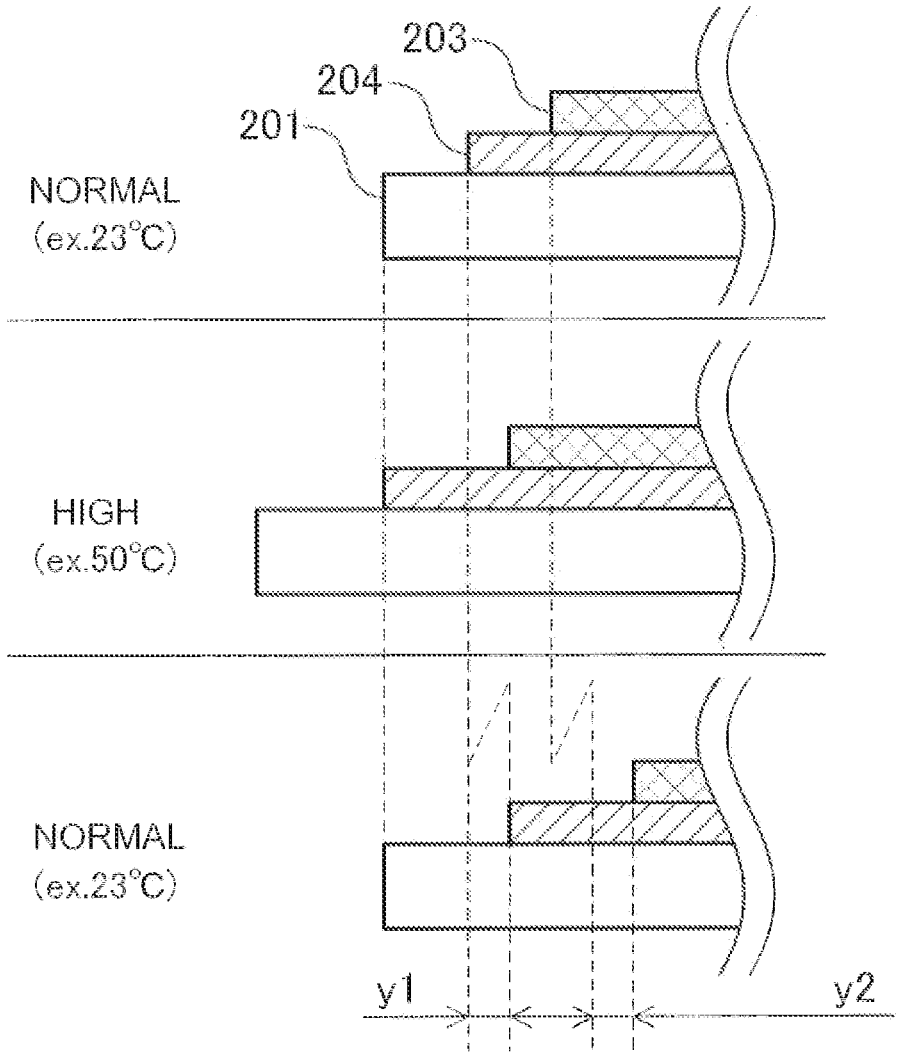

FIG. 34 is a schematic view showing a change in state of interfacial deviation in environments of normal temperature and high temperature.

Figure 35:
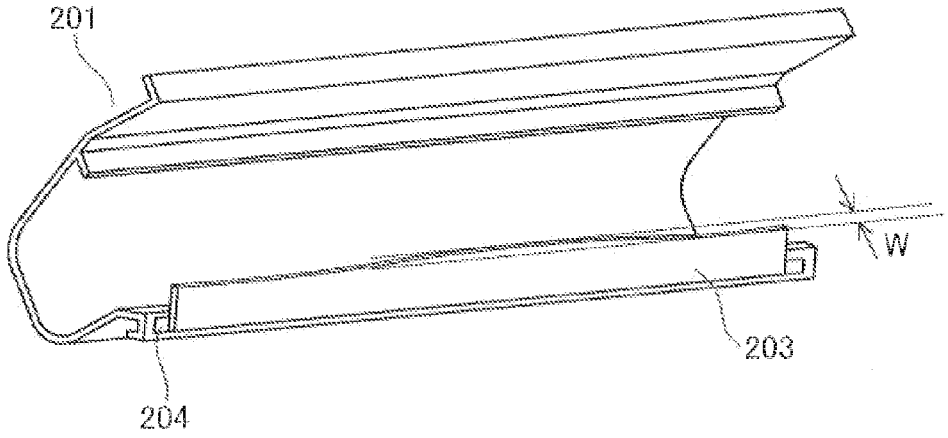

FIG. 35 is an illustration showing a waving state of an upper edge of the receptor sheet.

Figure 36:
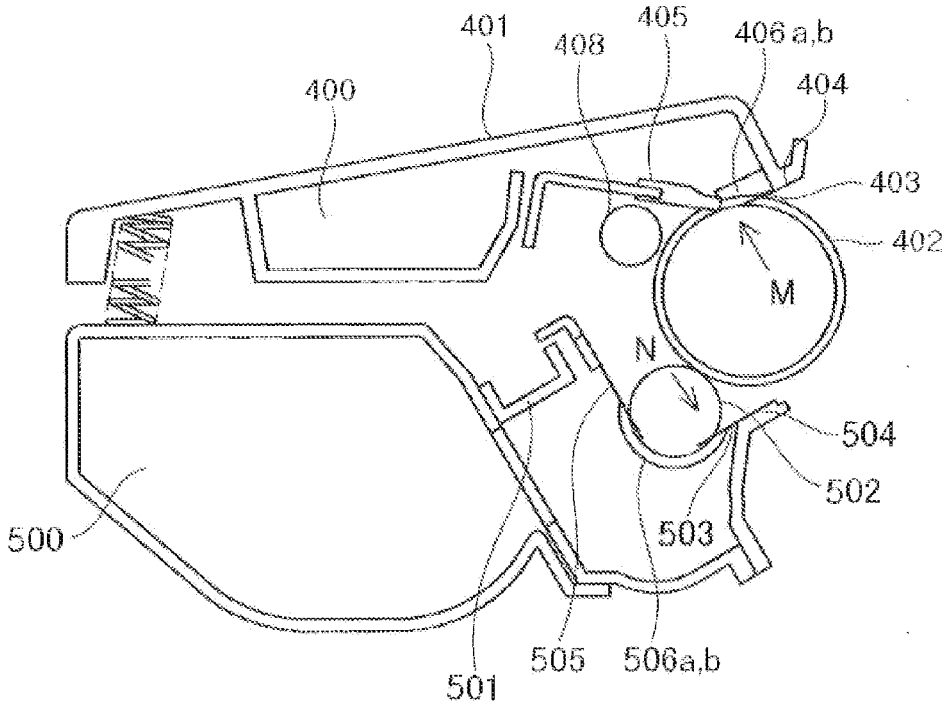

FIG. 36 is a schematic sectional view of a conventional process cartridge.

Figure 37:
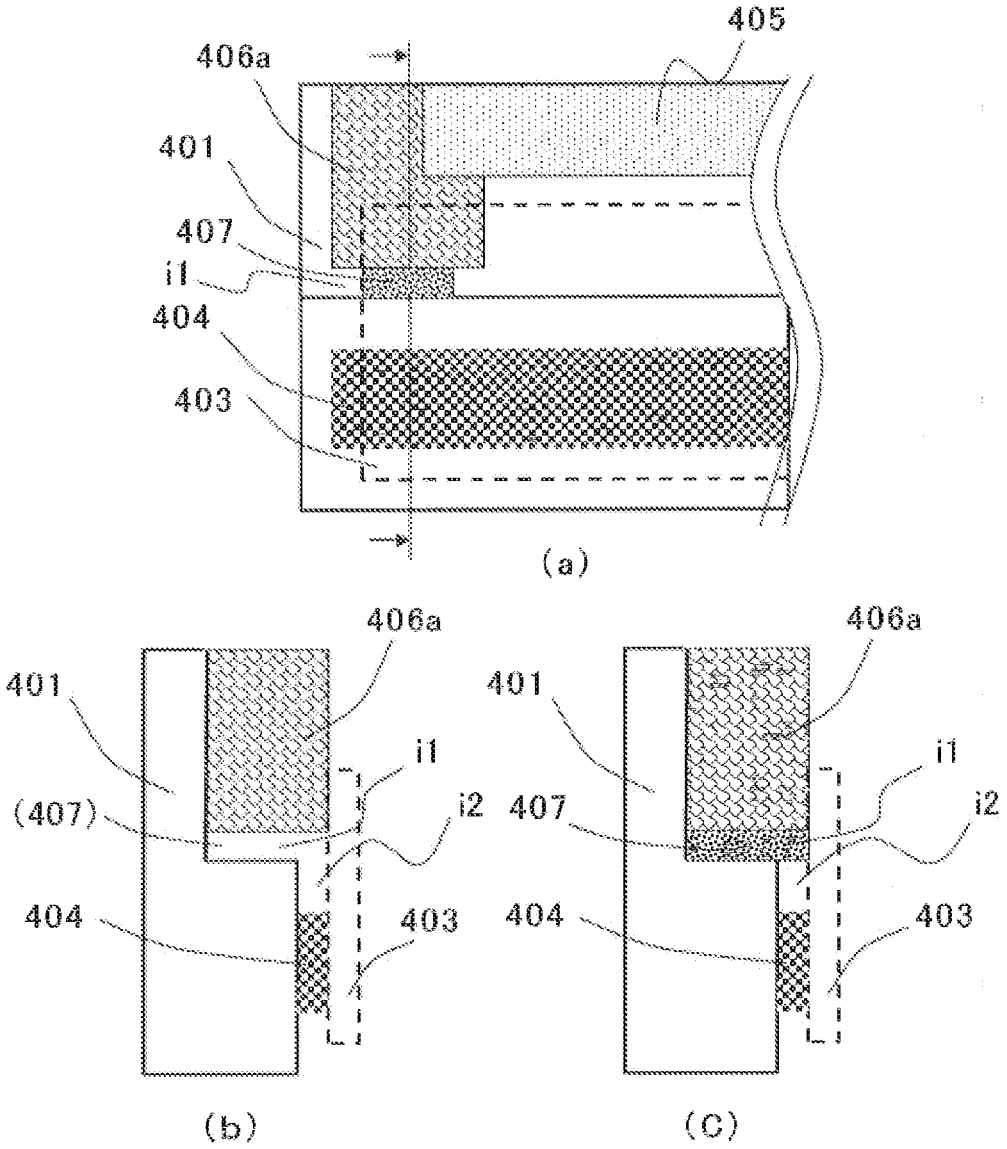

Part (a) of FIG. 37 is a schematic front view showing a receptor sheet application state at an end portion in a conventional constitution, and (b) and (c) of FIG. 37 are schematic sectional views showing the receptor sheet application state.

Figure 38:
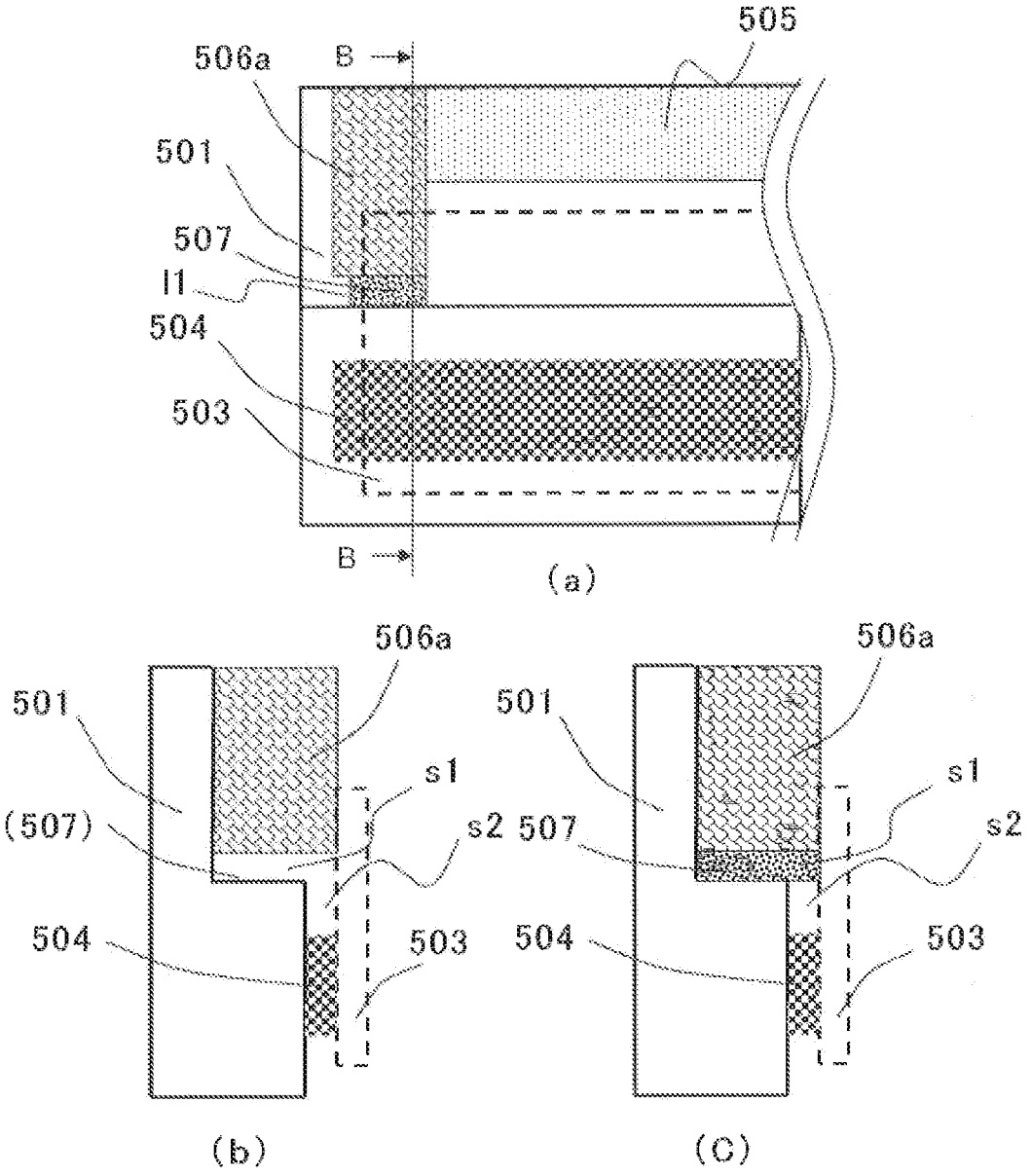

Part (a) of FIG. 38 is a schematic front view showing a blowoff preventing sheet application state at an end portion in the conventional constitution, and (b) and (c) of FIG. 38 are schematic sectional views showing the blowoff preventing sheet application state.

Figure 39:
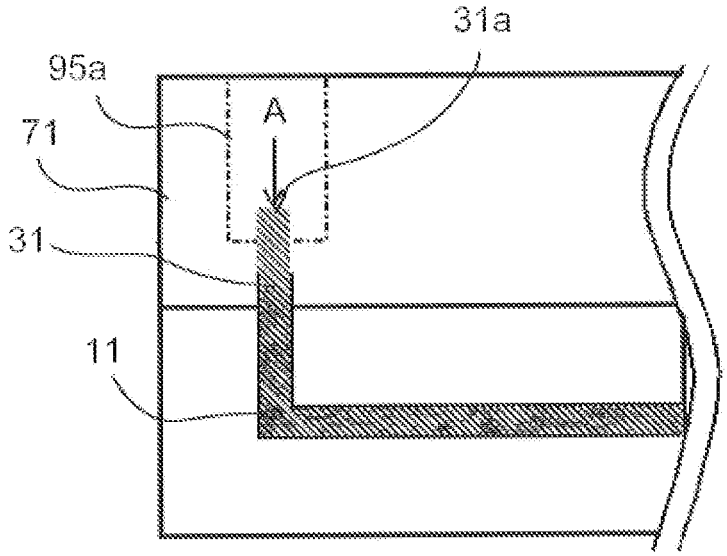
Figure 39:
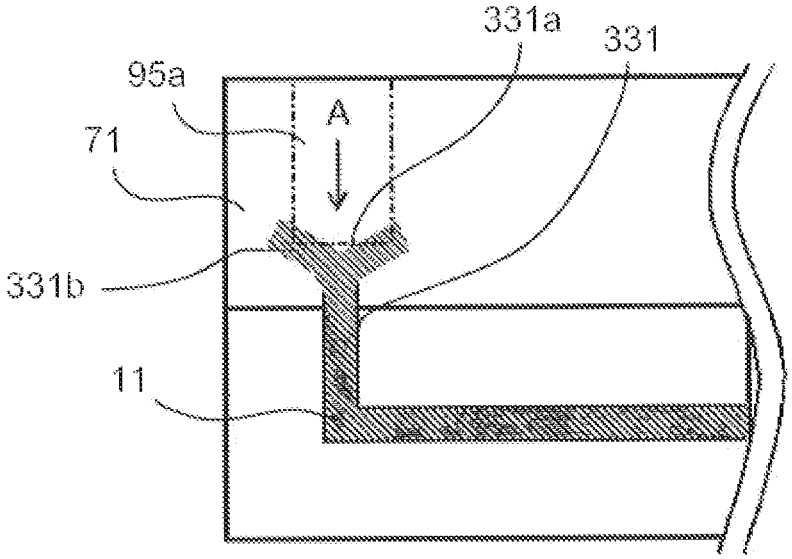

Parts (a) and (b) of FIG. 39 are illustrations during molding of a sealing portion on a developing container.

DESCRIPTION OF THE PREFERRED EMBODIMENTS

Hereinbelow, embodiments for carrying out the present invention will be exemplarily and specifically described based on a specific embodiment with reference to the drawings. However, dimensions, materials, shapes, relative arrangements and the like of constituent elements described in the following embodiments are appropriately changed depending on constitutions or various conditions or devices (apparatuses) to which, the present invention is applied. That is, the scope of the present invention is not limited thereto.

In the following description, a longitudinal direction of a process cartridge is a direction (rotational axis direction of an image bearing member) crossing (substantially perpendicular to) a direction in which the process cartridge is mounted into an electrophotographic image forming apparatus main assembly. Left and right of the process cartridge are those as seen from the direction in which the process cartridge is mounted into the electrophotographic image forming apparatus main assembly.

An upper surface of the process cartridge is a surface located at an upper portion of the process cartridge in a state in which the process cartridge is mounted in the electrophotographic image forming apparatus main assembly, and a lower surface is a surface located at a lower portion of the process cartridge in the mounted state. Further, in FIGS. 2, 3, 6, 32 and 36, a structure of members contacted to each other is shown in a state before deformation.

(Structure of Image Forming Apparatus Main Assembly)

Figure 1:
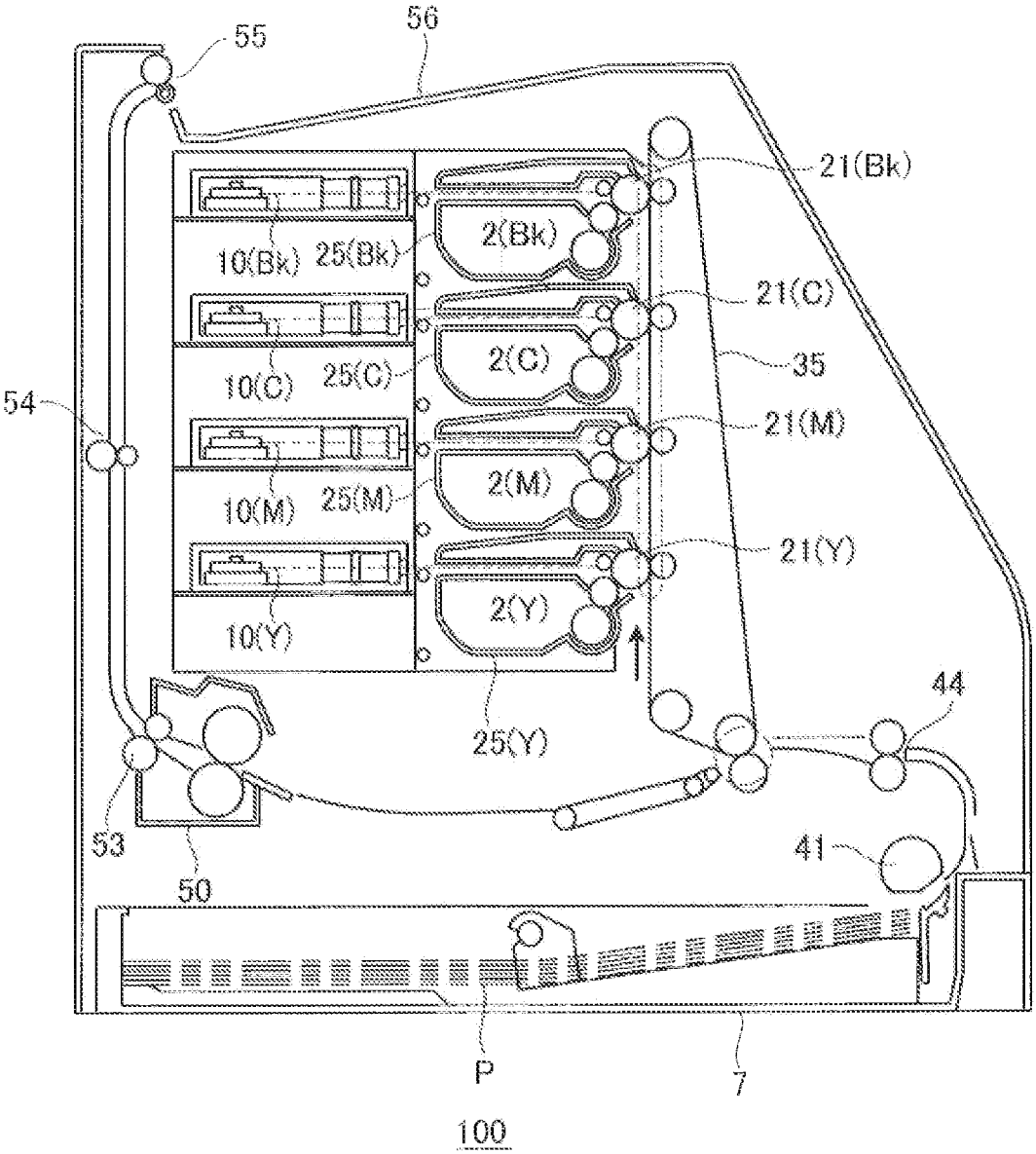
FIG. 1 is a schematic sectional view showing a general structure of an image forming apparatus.

A structure of a main assembly of the electrophotographic image footing apparatus in this embodiment, according to the present invention will be described with reference so FIG. 1. FIG. 1 is a schematic sectional view of a color laser beam printer as an example of the image forming apparatus (hereinafter referred to as an image forming apparatus main assembly). An image forming apparatus main assembly 100 includes process cartridges 2 for colors of Y (yellow), M (magenta), C (cyan) and Bk (black), an intermediary transfer belt (intermediary transfer member) 35, a fixing portion 50, a group of discharging rollers 53, 54 and 55, and a discharge tray 50. The process cartridges 2 for the four colors are independently constituted, so as to be detachably mountable to the image forming apparatus main assembly 100.

Next, an operation of the image forming apparatus main assembly 100 will be described. First, a sheet feeding roller 41 is rotated to separate a sheet of a transfer material P as a recording material or medium P in a sheet feeding cassette 7 and then feeds the transfer material P to a registration roller 44. On the other hand, an image bearing members 21 and the intermediary transfer member 35 are rotated in an arrow direction in FIG. 1 at a predetermined outer peripheral speed V (hereinafter referred to as a process speed). A surface of the image bearing member 21 is electrically charged uniformly by the charging means and is subjected to exposure to light by a laser, so that as electrostatic latent image is formed. Simultaneously with this latent image formation, a developing unit 2*b* develops the latent image on the image bearing member 21 with a developer (toner). The color images of Y, M, C and Bk formed on the image bearing member 21 by development are primary-transferred onto an outer peripheral surface of the intermediary transfer member 35. The respective color images transferred onto the intermediary transfer member 35 are secondary-transferred onto the transfer material P and thereafter are fixed on the transfer material P. The transfer material P on which the images are fixed is discharged onto the discharge tray 56 via the discharge roller pairs 53, 54 and 55, so that the image forming operation is ended.

(Structure of Process Cartridge)

Figure 2:
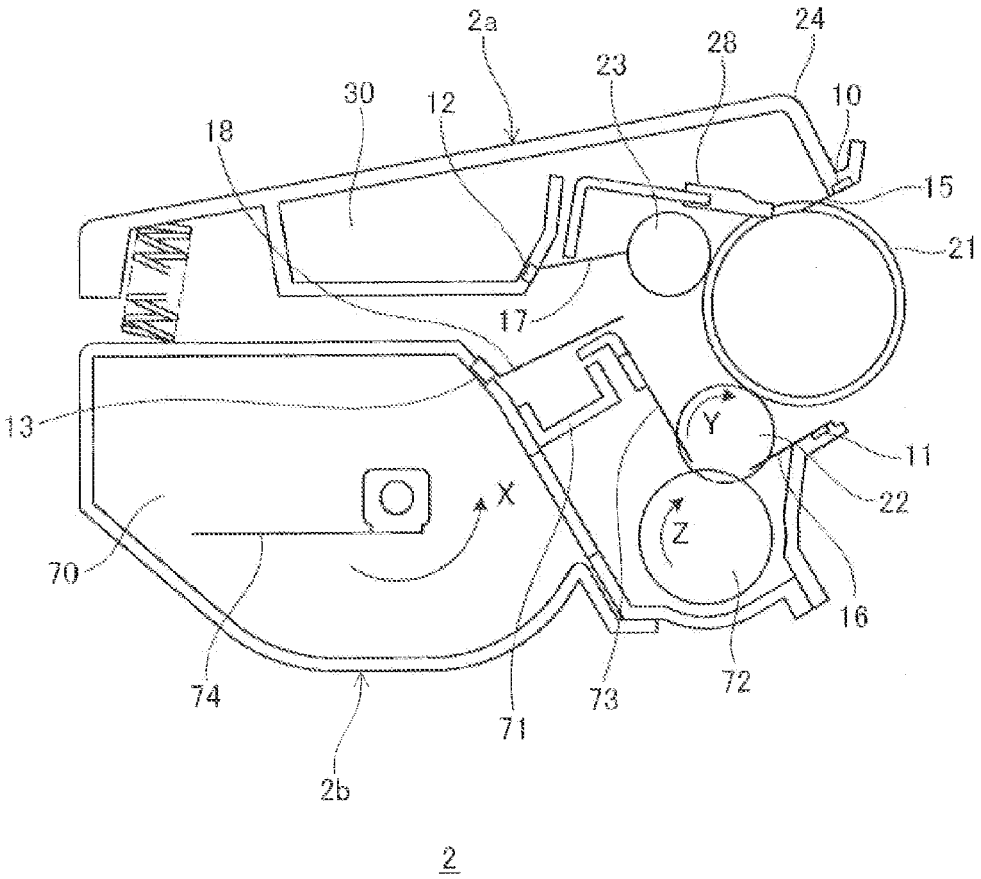
FIG. 2 is a schematic sectional view showing a process cartridge.

With reference to FIG. 2, a structure of the process cartridge 2 in this embodiment will be described. FIG. 2 is a schematic sectional view of the process cartridge 2. The process cartridges for Y, M, C and Bk have the same constitution. The process cartridge 2 is divided into a cleaning unit 2*a* and a developing unit 2*b*.

In the cleaning unit 2*a*, the image bearing member 21 as a rotatable member is rotatably mounted, to a cleaning container 24. On a peripheral surface of the image bearing member 21, a charging roller 23 as a primary charging means for uniformly charging the surface of the image bearing member 21 and a cleaning blade 28 for removing the toner remaining on the image bearing member 21 are provided. Further, a receptor sheet (turn plate member) 15 as a flexible sheet member for scooping she toner removed by the cleaning blade 28 and an elastomer member 10 as a resin member on which the receptor sheet 15 is fixed are provided. Further, a charging roller cleaner 17 for cleaning the charging roller 23 and an elastomer member 12 for fixing the charging roller cleaner 17 are provided.

The developing unit 2*b* is constituted by a developer carrying member 22 which is a rotatable member as a developing means, a toner container 70 accommodating the toner, and a developing container 71. The developer carrying member 22 is rotatably supported by the developing container 71. On a peripheral surface of the developer carrying member 22, a toner supplying roller 72 rotating an arrow Z direction in contact with the developer carrying member 22, a developer regulating member 73, a blowoff preventing sheet (sheet member) 16, and an elastomer member which is a resin member for fixing the blowoff preventing sheet 16 are provided. Further, in the toner container 70, a toner stirring mechanism 74 is provided.

Next, an operation of the process cartridge 2 will be described. First, the toner is fed to the toner supplying roller 72 by the toner stirring mechanism 74 rotating in an arrow X direction in FIG. 2. The toner supplying roller 72 supplies the toner to the developer carrying member 22 by rotating in the arrow z direction. The toner supplied onto the developer carrying member 22 reaches a position of the developer regulating member (developing blade unit) 73 by rotation of the developer carrying member 22 in an arrow Y direction. The developer regulating member 73 regulates the toner to impart a desired electric charge amount to the toner and to form a predetermined thin toner layer. The toner regulated by the developer regulating member 73 is fed to a developing portion where the image bearing member 21 and the developer carrying member 22 contact and is used for development on the image bearing member under application of a developing bias to the developer carrying member 22. The toner used for development on the image bearing member 21 is primary-transferred onto the intermediary transfer member 35 and thereafter a residual toner remaining on the image bearing member 21 is removed by a cleaning blade 28. The removed residual toner is stored in a residual toner chamber (developer accommodating portion) 30.

(Cleaning Unit)

Figure 3:
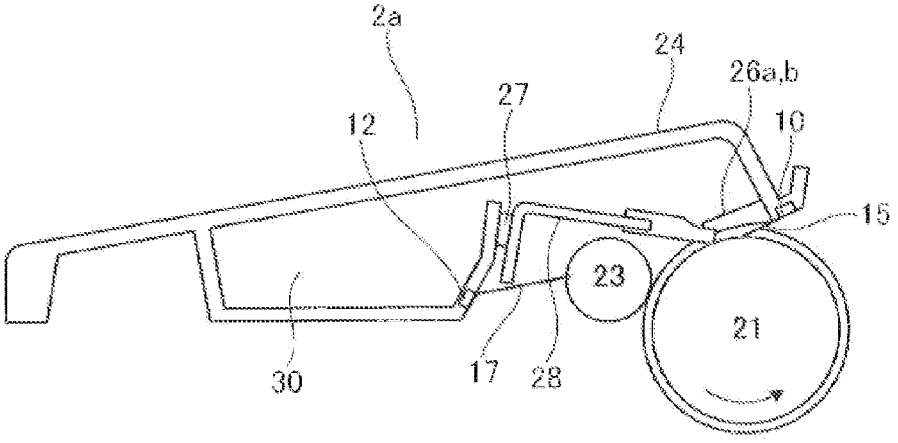
FIG. 3 is a schematic sectional view showing a structure of a cleaning member and an image bearing member.
Figure 4:
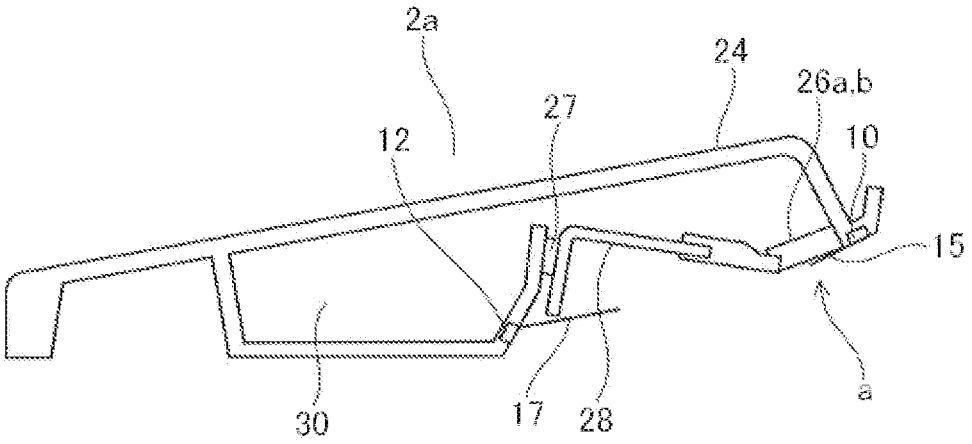
FIG. 4 is a schematic sectional view showing a structure of the cleaning member of a cleaning unit.
Figure 5:
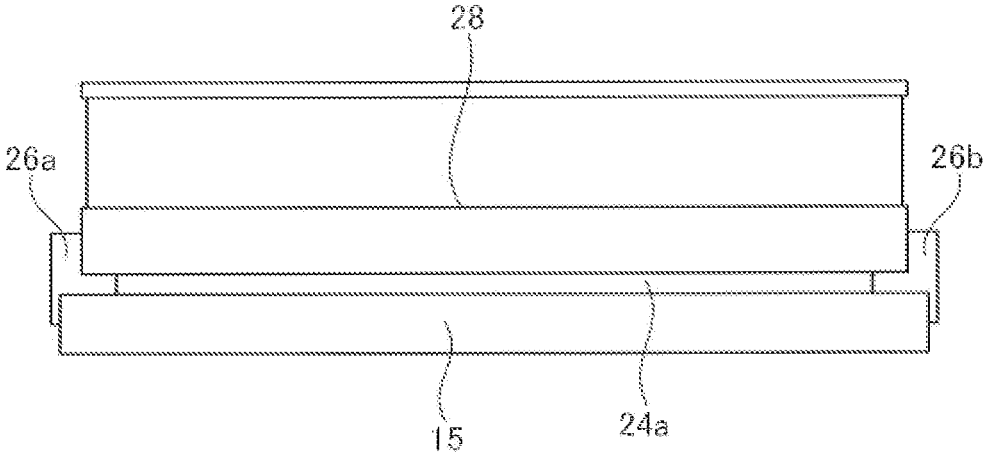
FIG. 5 is a schematic illustration of the cleaning member as seen from an arrow a direction shown in FIG. 4.

With reference to FIGS. 3 to 5, a structure of the cleaning unit 2*a* will be described. FIG. 3 is a schematic sectional view showing the cleaning member and the image bearing member 21, FIG. 4 is a schematic sectional view showing a structure of the cleaning member, and FIG. 5 is an illustration of the cleaning means as seen from an arrow a direction in FIG. 4.

As shown in FIGS. 3 and 4, the cleaning blade 28 for scraping off a residual matter such as the residual toner from the image bearing member 21, and the receptor sheet 15 for scooping the scraped residual toner are provided. Further, the residual toner chamber 30 for accommodating the residual matter, image bearing member end portion seal members 26*a* and 26*b*, provided at end portions of the cleaning blade 28 so as to prevent the residual matter from leaking out of the residual toner chamber 30, and an under-cleaning blade seal 27 are provided. These members are incorporated into an assembled with the cleaning container 24 to constitute the cleaning unit 2*a*, Specifically, as shown in FIG. 5, the cleaning blade 28 and the receptor sheet 15 contact the outer peripheral surface of the image bearing member 21 at a position where they do not interfere with each other, and where an opening 24*a* is formed. The receptor sheet 15 is welded on an elastomer member 10 portion termed by injection molding, as the adhesive member for the receptor sheet 15, on the cleaning container 24. This will be described later specifically. The image bearing member 21 is configured such that it is disposed at the opening 24*a* of the cleaning container 24, and the receptor sheet 15 is provided for presenting the toner from leaking out from a gap between the cleaning container 24 and the image bearing member 21 by the contact with the image bearing member 21. Further, the image bearing member end portion seal members 26*a* and 26*b* are disposed on the basis of the cleaning blade 28 as shown in FIG. 5 and are contacted to the receptor sheet 15 at end portions, and are also contacted to the outer peripheral surface of the image bearing member 21 as shown in FIG. 3. Further, by the under-cleaning blade seal 27, a gap between the cleaning blade 28 and the cleaning container 24 or the like gap is hermetically sealed.

Further, a charging roller cleaner 17 for cleaning the charging roller 23 is provided and welded on an elastomer member 12 portion molded, as an adhesive member for the charging roller cleaner 17, on the cleaning container 24.

(Developing Unit)

Figure 6:
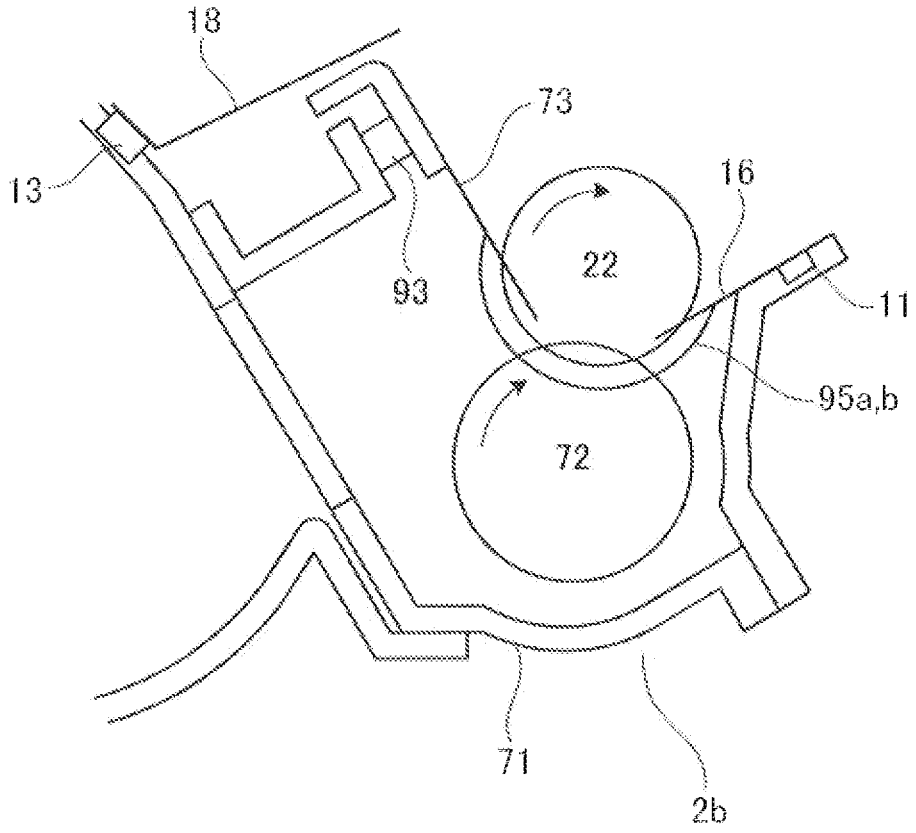
FIGS. 6 and 7 are schematic sectional views each showing constituent members of a developing unit.
Figure 7:
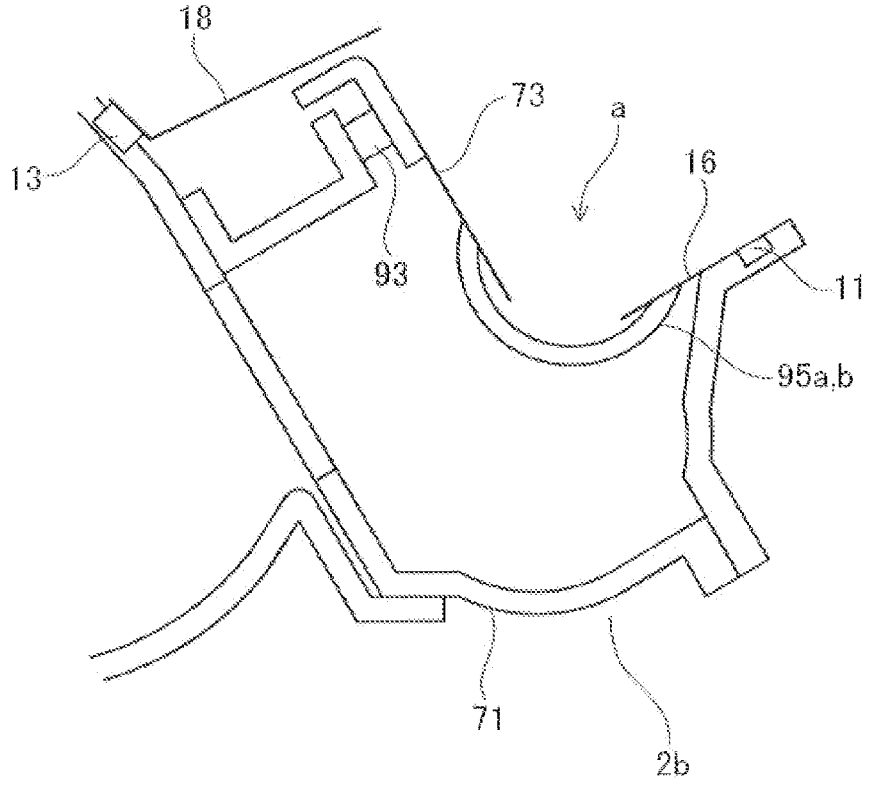
Figure 8:
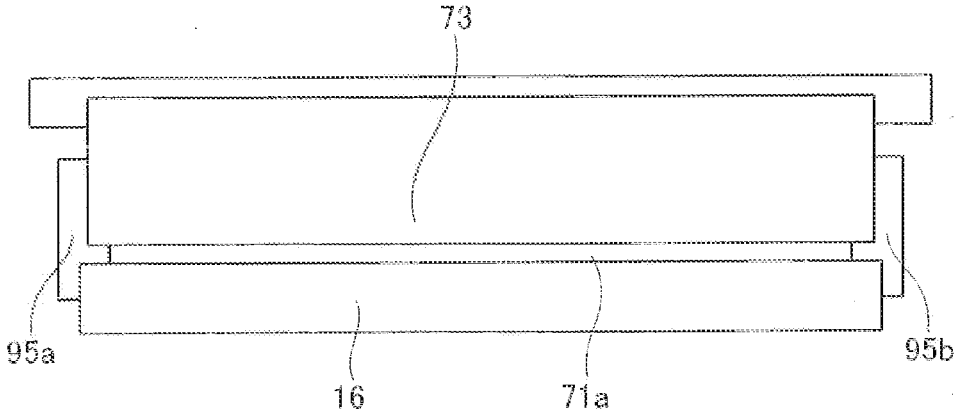
FIG. 8 is a schematic illustration of the developing unit as seen from an arrow a direction shown in FIG. 7.

With reference to FIGS. 6 to 8, a structure of the developing unit 2*b* will be described. FIG. 6 is a schematic sectional view showing the blowoff preventing sheet 16, the developing blade unit 73, developer carrying member end portion seal members (first end portion seal members) 95*a* and 95*b*, and the developer carrying member 22. Hereinafter, the developer carrying member end portion seal member is referred to as a D end portion seal member. FIG. 7 is a schematic sectional view showing the blowoff preventing sheet 16, the developing blade unit 73, and the D end portion seal members 95*a* and 95*b*. FIG. 8 is a schematic view of these members as seen from an arrow a direction shown in FIG. 7.

As shown in FIGS. 6 and 7, the developing blade unit 73 for uniformizing tire toner on the developer carrying member 22 and tire blowoff preventing sheet 16 for preventing the toner from blowing off from a gap between the developer carrying member 22 and the developing container 71 are provided. Further, the developing container 71 for accommodating the toner, the D end portion seal members 95*a* and 95*b* provided at end portions of the developing blade unit 73 so as to prevent the residual matter from leaking out of the process cartridge 71, and an under-developing blade seal 93 are provided. These members are incorporated into an assembled with the developing container 71 to constitute the developing unit 2*a*.

Specifically, as shown an FIG. 8, the developing blade unit 73 and the blowoff preventing sheet 16 contact the outer peripheral surface of the developer carrying member 22 at a position where they do not interfere with each other and where an opening 71*a* is formed. Tire blowoff preventing sheet 16 is welded on an elastomer member 11 portion molded, as an adhesive portion for the blowoff preventing sheet 16, on the developing container 71. This will be described later specifically. Further, the D end portion seal members 95*a* and 95*b* are, as shown in FIG. 8, contacted to the developing blade unit 73 and the blowoff preventing sheet 16 at end portions, and are also contacted to the outer peripheral surface of the developer carrying member 22 as shown in FIG. 6. Further, by the under-developing blade seal 93, a gap between the developing blade unit 73 and the developing container 71 or the like gap is hermetically sealed.

Further, as shown in FIG. 3, a scattering preventing sheet 18 for preventing toner scattering is provided and welded on an elastomer member 13 portion melded, as an adhesive portion for tire scattering preventing sheet, on the developing container 71.

(Molding of Elastomer Member)

With reference to FIGS. 9 to 11, a molding process of the elastomer member 10 will be described. Parts (a) to (d) of FIG. 9 are schematic views for illustrating molding of the elastomer member 10, wherein (a) or FIG. 9 includes a schematic view of the cleaning container 24 and a schematic enlarged view of an injection port portion, (b) of FIG. 9 is a schematic view showing a state in which an elastomer molding metal mold 83 is clamped on the cleaning container 24, (c) of FIG. 9 is a schematic sectional view taken along A-A line indicated in (b) of FIG. 9, and (d) of FIG. 9 is a schematic sectional view taken along B-B line indicated in (b) of FIG. 9. FIG. 10 is a schematic sectional view taken along the A-A line indicated in (b) of FIG. 9 and shows a state of the elastomer member 10 during molding. FIG. 11 is a schematic view showing the state of the elastomer member during molding.

As shown in (a) to (d) of FIG. 9, an elastomer member-forming portion 71*d* is provided between the image bearing member end portion seal members 26*a* and 26*b* in an end side and another end side, respectively, of the cleaning container 24. The elastomer member-forming portion 71*d* includes a recessed portion 71*d*1 into which the elastomer member 10 is to be injected, and contact surfaces 71*d*2 and 71*d*3 to which the metal mold is to be contacted. Further, at a predetermined longitudinal position, a cylindrical injection port 76 which communicates with the recessed portion 71*d*1 of tire seal (elastomer member forming post ran 71*d* is provided.

Next, a molding method of the elastomer member 10 will be described. In this embodiment, as shown in (a) of FIG. 9, she injection, port 76 is provided at one longitudinal central portion of the elastomer member-forming portion 71*d* but may also be provided at two positions or more. When the elastomer member 10 is molded, as shown in (c) and (d) of FIG. 9, the elastomer molding metal mold 83 is contacted to the contact surfaces 71*d*2 and 71*d*3 of the elastomer member-forming portion 71*d* of the cleaning container 24. The elastomer molding metal mold 83 is configured to be cut into a shape of the elastomer member 10, i.e., is provided with a recessed portion 83*d* having a shape corresponding to an outer shape of the elastomer member 10. Then, a gate 82 of a resin material injection device is contacted to the injection port 76 provided at the one longitudinal central portion of the cleaning container 24. Then, a thermoplastic elastomer (resin material) for constituting the elastomer member 10 is injected from the gate 82 of the resin material injection device into the injection port 76 of the cleaning container 24 as indicated by an arrow in (c) of FIG. 9. The injected thermoplastic elastomer is caused to flow into a molding space formed, as shown in FIG. 10, by the recessed portion 71*d*1 of the elastomer member-forming portion 71*d* or the cleaning container 24 and the recessed portion 83*d* of the elastomer molding metal mold 83. The thermoplastic elastomer injected from the one longitudinal central, portion flows, as shown in FIG. 11, in the molding space formed by the recessed portion 71*d*1 of the elastomer member-forming portion 71*d* and the recessed portion 83*d* of the elastomer molding metal mold 83, toward longitudinal end sides. Thus, the thermoplastic elastomer is injected and molded in the molding space formed by bringing the mold into contact with the cleaning container 24, so that the elastomer member 10 is molded, integrally with the cleaning container 24.

The elastomer member 10 is integrally molded with the cleaning container 24. In this embodiment, as the material for the elastomer member 10, a styrene-based elastomer resin material is used. This is because the cleaning container 24 is formed of high-impact polystyrene (HI-PS) and therefore as the elastomer resin material, the styrene-based elastomer resin material which is the same type material as HI-PS and has elasticity is preferred. When parts of the same type resin materials are used, the parts are not required to be disassembled from each other and therefore the parts are excellent in disassembling operatively during recycling of the process cartridge. Incidentally, an elastomer resin toner other than the above-described elastomer resin material may also be used so long as it has a similar mechanical characteristic.

In this embodiment, as the elastomer member 10 to be formed by the molding, an elastomer member having a physical property of 2.5 MPa to 10 MPa in elastic modulus is used. Adjustment of the elastic modulus was effected by incorporating 20 wt, parts of polyethylene (PE) into 100 wt. parts of the styrene-based elastomer resin material. However, the elastomer resin material may only be required to provide the resultant elastomer member with the elastic modulus of 2.5 MPa to 10 MPa, and therefore the content of PE may be changed and a resin material other than PE may also be used. It is also possible to use other elastomer resin materials. Further, each of the image bearing member end portion seal member and the develop end portion seal member is formed with an elastic member or a fiber-like member but the present invention is not limited thereto.

The above-described molding method of the elastomer member 10 with the cleaning container 24 may also be applicable to molding of the elastomer members 11 and 13 with the developing container 71 and molding of the elastomer member 21 with the cleaning container 24. Incidentally, as the molding method of the elastomer members 10, 11, 12 and 13, in addition to the above-described molding method, it is also possible to effect the molding on the frame such as the cleaning container 24, the developing container 71 or the like by two-color molding, insert molding or the like.

In the case of a conventional method using a double-side tape as the adhesive portion, the double-side tape is soft and therefore it is more difficult to apply the double-side tape onto the frame with a narrower width of the double-side tape. However, in this embodiment, the elastomer resin material is directly molded into the elastomer member with the frame by using the mold, so that the elastomer member can be formed on the frame with a higher degree of accuracy than that of the double-side tape. Further, in the case of the conventional method using the double-side tape as the adhesive portion, after the resultant structure is left standing in a high temperature environment, deviation is generated at a bonded interface between the double-side tape and the frame. However, in this embodiment, the elastomer member is directly formed on the frame by molding, so that it is possible to suppress deviation at a bonded interface between the elastomer member and the frame.

(Molded Shape of Elastomer Member on Container)

Figure 12:
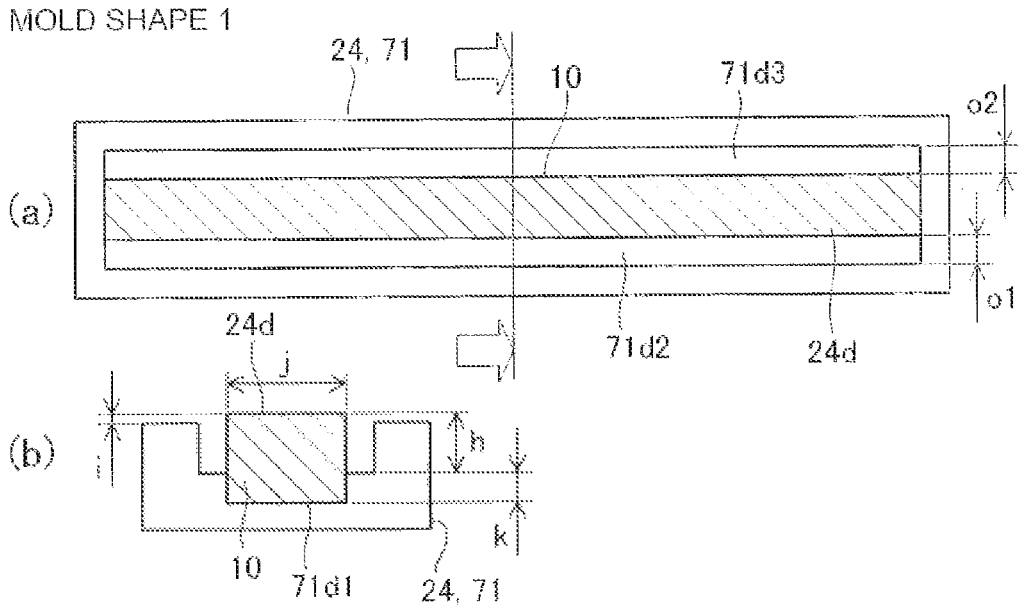
Figure 13:
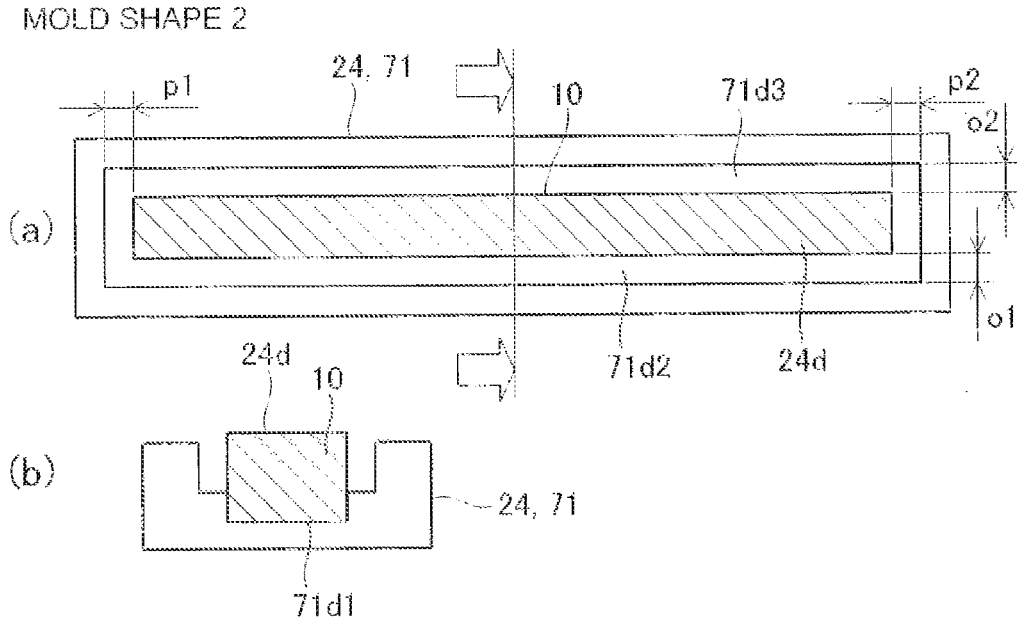
Figure 14:
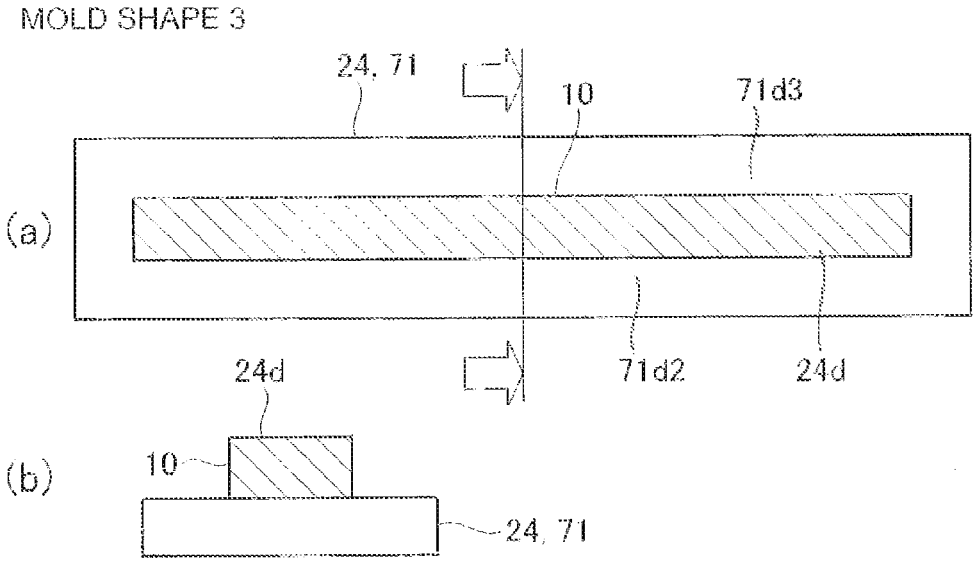
Figure 15:
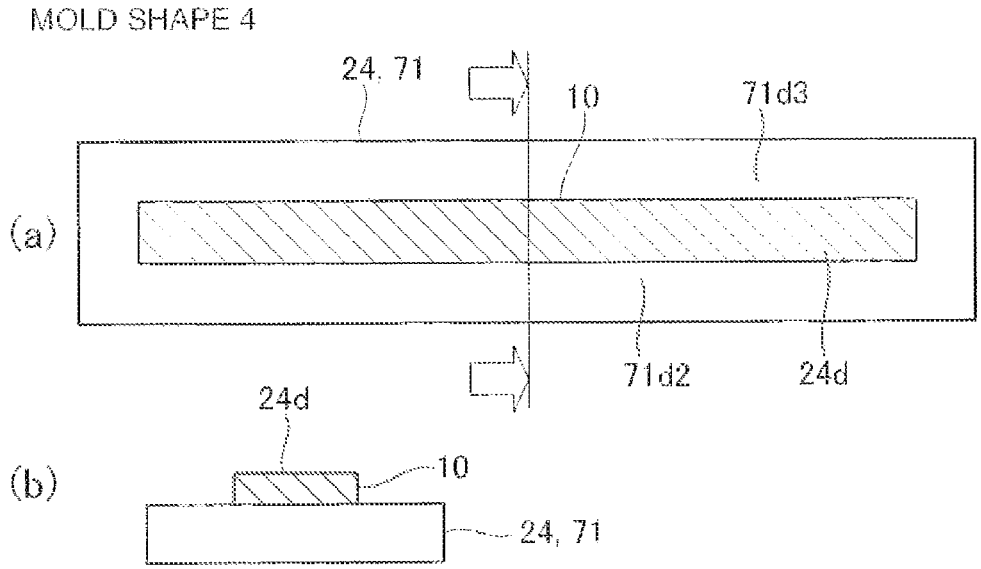
Figure 16:
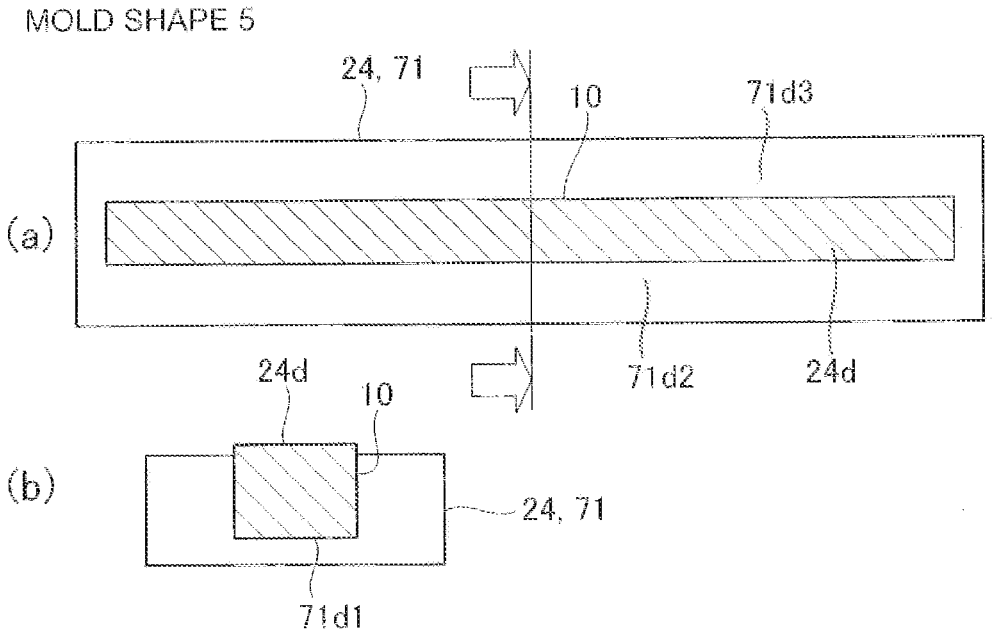
Figure 17:
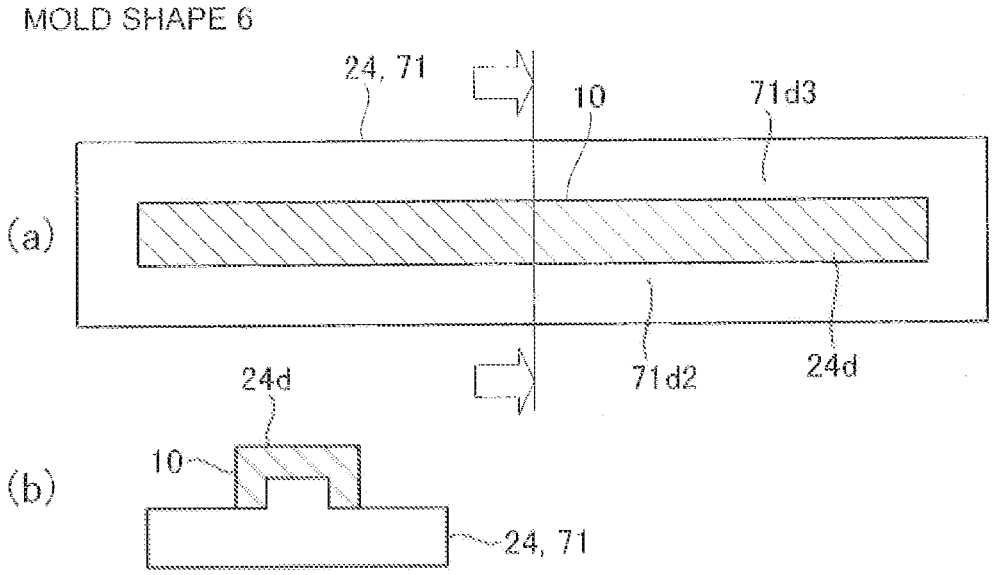

With reference to FIGS. 12 to 17, various structural examples of molded shapes of the elastomer members 10, 11, 12 and 13 integrally molded with the frame (such as the cleaning container 24 or the developing container 71) and the elastomer member-forming portion on the frame will be described, Parts (a) and (b) of FIG. 12 are schematic views for illustrating a molded shape 1 of the elastomer member 10, in which (a) of FIG. 12 is a schematic front view showing the elastomer member 10 and a part of tire frame, and (b) of FIG. 12 is a schematic sectional view taken along a line indicated by arrows in (a) of FIG. 12. Parts (a) and (b) of FIG. 13 are schematic views for illustrating a molded shape 2 of the elastomer member 10, in which (a) of FIG. 13 is a schematic front view showing the elastomer member 10 and a part of the frame, and (b) of FIG. 13 is a schematic, sectional view taken along a line indicated by arrows in (a) of FIG. 13. Parts (a) and (b) of FIG. 14 are schematic views for illustrating a molded shape 4 of the elastomer member 10, in which (a) of FIG. 14 is a schematic front view showing the elastomer member 10 and a part of the frame, and (b) of FIG. 14 is a schematic sectional view taken along a line indicated by arrows in (a) of FIG. 14. Parts (a) and (b) of FIG. 15 are schematic views for illustrating a molded shape 2 of the elastomer member 10, in which (a) of FIG. 15 is a schematic front view showing the elastomer member 10 and a part of the frame, and (b) of FIG. 15 is a schematic sectional view taken along a line indicated by arrows in (a) of FIG. 15. Parts (a) and (b) of FIG. 16 are schematic views for illustrating a molded shape 5 of the elastomer member 10, in which (a) of FIG. 16 is a schematic front view showing the elastomer member 10 and a part of the frame, and (b) of FIG. 16 is a schematic sectional view taken along a line indicated by arrows in (a) of FIG. 16. Parts (a) and (b) of FIG. 17 are schematic views for illustrating a molded shape 6 of the elastomer member 10, in which (a) of FIG. 17 is a schematic front view showing the elastomer member 10 and a part of the frame, and (b) of FIG. 17 is a schematic sectional view taken, along a line indicated by arrows in (a) of FIG. 17.

As show in (a) and (b) of FIG. 12, in the molded shape 1, the elastomer member 10 formed by molding at the recessed portion as the elastomer member-forming portion 71*d*1 of the frame is in non-contact with the frame with widths o1 and o2, which are larger than 0 mm, with respect to an entire widthwise region except for longitudinal end portions, That is, a regulating portion capable of regulating a position of the sheet member of the frame is provided with spacings o1 and o2 from the elastomer member 10 with respect to the widthwise direction of the elastomer member 10.

Further, as shown in (b) of FIG. 12, the elastomer resin material is molded while ensuring a free length (height) h of 0.5 mm or more and entering the frame with a depth k of 0.3 mm during the molding into the elastomer member 10. That is, the elastomer resin material is injected, and molded, so that a part of the elastomer member 10 enters the recessed portion of the frame. This is because a sheet welding portion of the elastomer member 10 is prevented from being influenced by elongation due to linear expansion of the frame under left-standing in the high temperature environment and also because the elastomer member 10 is fixed on the frame. Further, a height of a sheet member mounting surface (contact position) 24 before welding of the elastomer member 10 is made higher than a height of a contact, surface (contact, position) of the frame to be contacted with the sheet member of the sheet member regulating portion, by an elastomer member melting margin i.

The molded shape of the elastomer member 10 in this embodiment tray only be required to possess the following features (1) to (3).

(1) The sheet member mounting surface 24*d* or the elastomer member 10 is not readily influenced by the elongation due to linear expansion of the frame under left-standing in the high temperature environment.

(2) The elastomer member 10 functions as a buffer layer which prevents the sheet member (thin plate member) such as the receptor sheet 10 from being influenced by the finest expansion of the frame.

(3) The elastomer member 10 is not easily detached from the frame.

When the above three features (1) to (3) are satisfied, as shown in (a) and (b) of FIG. 13, a constitution (molded shape 2) in which the elastomer member 10 is in non-contact with the frame in entire longitudinal and widthwise regions with widths p1 and p2 which are larger than 0 mm and with widths o1 and o2 which are larger than 0 mm may also be employed. Further, when the elastomer member 10 has an adhesive property, as shown in (a) and (b) of FIG. 14, a constitution (molded shape 3) in which the frame is not provided with the recessed portion but the elastomer member 10 is formed in a protected shape on the flat surface of the frame may also be employed. Further, in the case where a sufficiently flexible elastomer member 10 is formed by molding, as shown in (a) and (b) of FIG. 15, a constitution (molded shape 4) in which the free length (height) from the frame is made smaller than that of the molded shape 1 may also be employed. Further, as shown in (a) and (b) FIG. 16, a constitution (molded shape 5) in which the depth of the elastomer member-farming portion 71*d*1 is made deeper than that of the molded shape 1 while making the free length from the frame smaller than that of the molded shape 1 may also be employed. Further, as shown in (a) and (b) of FIG. 17, a constitution (molded shape 6) in which she elastomer member 10 is formed by molding so as to cover a projected portion provided on the frame may also be employed.

The above-described various structural examples of the molded, shapes of the elastomer member 10 with she cleaning container 24 are also applicable to molded shapes of the elastomer members 11 and 13 with the developing (container 71 and molded shapes of the elastomer member 12 with the cleaning container 24.

In the case of the conventional method using the double-side tape as the adhesive portion, the double-side tape functions as a buffer material for absorbing a difference in linear expansion, under left-standing in the high temperature environment, between the frame and the sheet member, so that waving of the sheet member after being left standing in the high temperature environment can be prevented. Therefore, also in this embodiment, by forming the elastomer member 10 on the frame by molding, fire elastomer member 10 can function as the buffer material for absorbing the difference in linear expansion, under left-standing in the high temperature environment, between the frame and the sheet member. By this effect, it becomes possible to prevent waving of the sheet member after being left standing in the high temperature environment.

(Sealing Portion Shape of Elastomer Member and Contact of Elastomer Member with End Portion Seal Member)

With reference to FIGS. 25 to 28, a contact state between an elastomer member 110 and an image bearing member end portion seal member (first end portion seal member) 126*a* when the elastomer member 110 is molded on a cleaning container 124 and thereafter the image bearing member end portion seal member 126*a* is applied will be described. Hereinafter, the image bearing member end portion seal member is referred to as a C end portion seal member.

Part (a) of FIG. 25 is a schematic front view of a molded shape when a sealing portion 131 as a second end portion seal member is formed before the C end portion seal member 126*a* is applied onto the cleaning container 125 in this embodiment according to the present invention. Part (b) of FIG. 25 is a schematic front view of another molded shape when a sealing portion 231 is formed before tire C end portion seal member 126*a* is applied onto the cleaning container 124 in this embodiment according to the present invention. Parts (a) and (b) of FIG. 26 are schematic views each showing a state in which a contact portion 131*a* of the sealing portion 131 or contact portions 231*a* and 231*b* of the sealing portion 231 are flexed before the C end portion seal member is applied onto the cleaning container 124. Part (a) of FIG. 27 is a schematic front view when a boundary portion 129 is formed in a contact state between the sealing portion 131 and the C end portion seal member 126*a* by applying the C end portion seal member 126*a* onto the cleaning container 124 after molding the sealing portion 131 on the cleaning container 124. Part (b) of FIG. 27 is a schematic sectional view taken along a line indicated by arrows in (a) of FIG. 27. Part (c) of FIG. 27 is a sectional view of the sealing portion 131 taken along C-C line indicated in (a) of FIG. 27. Parts (a) and (b) of FIG. 28 are schematic front and sectional views, respectively, showing another contact state when the sealing portion 131*b* is molded on the cleaning container 124 and then the C end portion seal member 126*a* is contacted and applied to the sealing portion 131*b* and the cleaning container 124.

As shown in (a) and (b) of FIG. 25, the elastomer member 110 is molded before the C end portion seal member 126*a* is applied onto the cleaning container 124, and the sealing portions 131 and 231 are integrally molded as a part of the elastomer member 110. The sealing portions 131 and 231 are molded in positions snob that the sealing portions 131 and 231 are contacted to the C end portion seal member 126*a* applied to the cleaning container 124. Further, shapes of the sealing portions 131 and 231 are, as shown in (a) and (b) of FIG. 25, an I-character shape and a Y-character shape, respectively, extending in a direction crossing a longitudinal direction of the image bearing member 21 (FIG. 2). The molding method of the elastomer member 110 is the same as that of the elastomer member 10 described above, and matters which are not particularly described herein are similar to those for the above-described elastomer member 10.

As shown in (b) of FIG. 27, a height a1 of the sealing portion 131 (231) in cross section is required to be at least equal to or larger than a width a2 from a contact surface z1 with the roller to an end portion seal member application bearing surface z2 (a1≥a2). This is because when a1≥a2, a gap is not generated between the sealing portion 131 (231) and the C end portion seal member 126*a*. This is also because in the case where a1≥a2, when the boundary portion 129 between the sealing portion 131 (231) and the C end portion seal member 126*a* is thermally melted (described later specifically), the sealing portion 131 (231) can be made flush with the C end portion seal, member 126*a*.

As shown in (a) of FIG. 26, the C (image bearing member) end portion seal member 126*a* is mounted on the cleaning container 124 in a state in which the contact portion 131*a* or the sealing portion 131 is flexed. At that time, a direction in which the contact portion 131*a* is fixed is z31 direction in the FIG., i.e., the longitudinal direction of the image hearing member, and therefore the contact portion 131*a* may desirably be flexed toward the outside of the cleaning container 124. In (a) of FIG. 24, a state before the flexure is indicated by a broken line. This is because by flexing the contact portion 131*a* toward the outside of the cleaning container 124, an inside application area when the C end portion seal member 126*a* is applied onto the cleaning container 124 can be ensured. Further, the sealing portion 131 may also be, as shown in (c) of FIG. 27, inclined and projected in advance from the cleaning container 124 with respect to z31 direction (longitudinal direction of the image bearing members). When such a shape is provided, it is possible to alleviate stress, exerted on a base portion 131*b* of the sealing portion 131 projected from the cleaning container 124, generated by the flexure of the sealing portion 131 as shown in (a) of FIG. 26.

As shown in (b) of FIG. 26, similarly also in the case of the sealing portion 231 having a bifurcated shape (Y-character shape) as shown in (b) of FIG. 25, the contact portions 231*a* and 231*b* contactable to the C end portion seal member 126*a* are flexed in z32 and z33 direction, respectively (longitudinal direction of the image bearing member). The sealing portion 231 can be flexed by an unshown jig (tool), and in a flexed state by the jig, the C end portion seal member 126*a* is mounted. Then, the jig is removed, so that the c end portion seal member 126*a* is contacted to the sealing portion 231. Incidentally, in the case where the sealing portions 131 and 231 can be flexed in predetermined shapes only by mounting the c end portion seal member 126*a* as it is, the above-described flexing operation by the jig may also be not performed.

By the above-described constitution, it becomes possible to reliably prevent leaking-out of the toner from among the c end portion seal member 126*a* (126*b*), the cleaning container 124 and the receptor sheet 15.

Further, as shown in (a) and (b) of FIG. 27, by mounting the c end portion seal member 126*a* so as to contact the sealing portion 131, the boundary portion 129 is formed therebetween. At another end, also the c end portion seal member 126*b* (not shown in FIG. 27) is similarly mounted.

Further, the molded shape of the sealing portion 131 in this embodiment may only be required that the sealing portion 131 contacts the c end portion seal members 126*a* and 126*b*, and therefore may also be a shape such that the sealing portion 131 contacts the c end portion seal member 126*a* (126*b*) with respect to the longitudinal direction of the cleaning container 124 as shown in (a) and (b) of FIG. 28. As the shape of the contact portion, a shape similar to the shape shown in (a) and (b) of FIG. 25 may only be required to be used. Further, at end portions, it is also possible to change the contact shape between the sealing portion 131 and the c end portion seal member 126*a* from the contact shape between the sealing portion 131 and the c end portion seal member 126*b* (different contact shapes). Further, in this embodiment, the elastomer member 110 and the sealing portion 131 are concurrently molded, but there is no problem, even when these portions are independently molded.

Further, in this embodiment, the sealing portions 131 and 231 provided on the cleaning container 124 are described, but as shown in FIG. 39, the present invention is also applicable to sealing portions 31 and 331 as a second end portion seal member provided on a developing container 71. That is, the sealing portions 31 and 331 are molded integrally with the elastomer member 10 and are configured to contact a D end portion seal member 95*a* (95*b*). Contact portions 31*a*, 331*a* and 331*b* where the sealing portions 31 and 331 are contactable to the D end portion seal member 95*a* may only be required to have an I-character shape as shown in (a) of FIG. 39 or a Y-character shape as shown in (b) of FIG. 39. The sealing portions 31 and 331 are molded on the developing container 71 before the D end portion seal member 95*a* is applied onto the developing container 71. Then, by applying the D end portion seal member 95*a* onto the developing container 71, the sealing portions 31 and 331 are flexed similarly as the sealing portion 131 shown in FIG. 27.

By the above-described constitution, it becomes possible to reliably prevent leaking-out of the Loner from among the D end portion seal member 95, the developing container and the blowoff preventing sheet 16.

(Sheet Welding)

With reference to FIGS. 18 to 23, a sheet welding step in this embodiment of the present invention will be described by taking the case where a semiconductor laser is used, as an example.

Parts (a) and (b) of FIG. 18 are schematic illustrations of the cleaning container on which the receptor sheet 15 is mounted, in which (a) of FIG. 18 shows a state in which waving of the receptor sheet 15 is not generated, and (b) of FIG. 18 shows a state in which waving of she receptor sheet 15 is generated. Parts (a) and (b) of FIG. 19 are schematic views for illustrating a method of imparting tension to an upper edge of the receptor sheet, in which (a) of FIG. 19 shows a stare in which the sheet member mounting surface aid of the cleaning container 24 is curved by a tension (pulling) jig 48, and (b) of FIG. 19 shows a state in which the tension is imparted to the upper edge of the receptor sheet 15 by relieving the curve of the sheet member mounting surface 24*d* of the cleaning container 24. FIG. 20 is a schematic view for illustrating a state in which the elastomer member 10 formed on the cleaning container 24 by molding is melted to weld the receptor sheet 15. FIG. 21 is a schematic sectional view showing the state of FIG. 20. FIG. 22 is a partially enlarged view of portion D shown in FIG. 21. FIG. 23 is a schematic view for illustrating the cleaning container 24 on which the receptor sheet 15 is welded on the elastomer member 10.

In this embodiment, the receptor sheet 15 formed of polyester with a thickness of 38 μm and a light transmittance of 85% (near infrared ray of 960 nm) was used. First, as shown in (a) of FIG. 18, the cleaning container 24 is prepared. In this case, as shown in (b) of FIG. 18, waving x can occur at an edge (contact portion with the image bearing member 21) of the receptor sheer 15 due to creases of the receptor sheet 15 itself, an environmental fluctuation, and the like. For this reason, when the receptor sheet 15 is mounted, as shown in (a) of FIG. 19, a force-receiving portion (for receiving a force when the sheet member mounting surface 24*d* is curved) of the sheet member mounting surface 24*d* of the cleaning container 24 is pulled downward by the tension jig 48. By elastic deformation at this time, the sheet member mounting surface 24*d* is curved, and the receptor sheet 15 is mounted in this state and thereafter the curve is released. In this way, by curving the cleaning container 14, an initial tension amount n is provided to the edge of the receptor sheet 15 as shown in (b) of FIG. 19, so that waving is prevented. In this embodiment, the initial tension amount n is provided in a range of 0.5 mm to 0.8 mm.

As shown in FIGS. 20 to 22, in this embodiment, in a state in which a lower portion of the sheet, member mounting surface 24*d* of the elastomer member 10 formed on the cleaning container 24 by molding is curved by using the tension jig 48, the receptor sheet 1.5 is superposed on the sheer member mounting surface 24*d* so as to be contacted to the sheet member mounting surface 24*d*. Further, the receptor sheet 15 is press-contacted, to a sheet position regulating surface 49 by using an urging jig 45, which is transparent to near infrared ray, from above the receptor sheet 15. As a result, the receptor sheet 15 is temporarily positioned so that a position of the receptor sheet 15 relative to the cleaning container 24 is not shifted (deviated) during bonding of the receptor sheet 15.

Thereafter, laser light e of near infrared ray is emitted from, a laser irradiation head 60, via the receptor sheet 15, toward the sheet member mounting surface 24*d* of the elastomer member 10 formed on the cleaning container 24 by molding. The elastomer member 10 contains carbon black so as to absorb near infrared ray. For this reason, the emitted laser light e passes through the urging jig 45 and the receptor sheet 15 which are transparent to near infrared ray, and is absorbed by the sheet member mounting surface 24*d* of the elastomer member 10 formed on the cleaning container 24 by molding. The laser light absorbed by the sheet member mounting surface 24*d* is conversed into heat and thus the sheet member mounting surface 24*d* generates heat, so that the elastomer member 10 is melted by the heat and thus can be welded with (bonded, to) the receptor sheet 15 contacting the sheet member mounting surface 24*d*.

Here, the laser light, e emitted from the irradiation head 60 was focused to a circular spot of 1.5 mm in diameter when it reaches the sheet member mounting surface 24*d*. That is a spot diameter of the laser light is 1.5 mm. Further, by making a molding width of the elastomer member smaller than 1.5 mm, it becomes possible to uniformly melt the sheet member mounting surface 24*d* of the elastomer member 10, Therefore, in this embodiment, a melting width e1 of the elastomer member 10 is about 1.0 mm. Further, the receptor sheet 15 is irradiated with the laser light continuously from an end portion thereof to another end portion thereof. As a result, a welded surface g1 continuously extending in the longitudinal direction as shown in FIG. 23 can be obtained.

Next, a welded state of the end portion will be described with reference to FIGS. 23 to 31. Part (a) of FIG. 29 is a schematic front view of the end portion state when a receptor sheet 115 is welded on a cleaning container 124. Part (b) of FIG. 29 is a sectional view of the end portion state of (a) of FIG. 29. Part (a) of FIG. 30 is a schematic front view of the end portion state when the receptor sheet 115 is welded on the cleaning container 124 until a position of a welded portion 130 of the boundary portion 129 in a sheet member side. Part (b) of FIG. 30 is a sectional view of the state of (a) of FIG. 30. Part (a) of FIG. 31 is a schematic front view shoving a gap between a cleaning container 24 and a receptor sheet 15 in a conventional constitution. Part (b) of FIG. 31 is a sectional view showing the gap of (a) of FIG. 31.

As shown in (a) and (b) of FIG. 29, when the receptor street 115 is laser-welded on an elastomer member 110, a welded surface all is formed. A portion from the welded surface g11 to the boundary portion 129 constitutes a non-welded portion g12 to generate a gap t1. However, the gap t1 is closed (clogged) in a product state. Specifically, as shown in (c) of FIG. 29, an image bearing member 121 is assembled with the receptor sheet 115, so that the receptor sheet 115 is flexed, and further try crushing a C end portion seal member 126*a*, the gap t1 is closed. As a result, it becomes possible to seal a gap h2 which was generated in the conventional constitution shown in (b) of FIG. 31. At this time, a gap h1 is sealed by contact of the C end portion seal member 126*a* with the sealing portion 131.

Further, there is the case where the sealing portion 131 causes permanent deformation by the contact thereof with the C end portion seal member 126*a*. When the case is taken into consideration, first, carbon black is contained in the sealing portion 131 so as to generate heat by a semiconductor laser, in this state, as shown in (a) and (b) of FIG. 30, the receptor sheet 115 is laser-welded so the position of the boundary portion 129, so that the welded, surface g11 which reaches the C end portion seal member 126*a* is obtained. Then, a melted matter of the sealing portion 131 enters a surface layer or the like of the C end portion seal member 126*a* and is integrated with the C end portion seal member 126*a* to form the welded portion 130. At this time, the gap t1 generated in the state of (a) of FIG. 23 can be eliminated. Further, in this embodiment, the welded portion 130 is formed by the semiconductor laser, but as a means for applying the heat, heat, seal or the like may also be used. Incidentally, in the case of the heat seal or the like, the heat cannot be applied to only a contact boundary between the receptor sheet 115 and the sealing portion 131, so that, the heat in conducted from an upper surface of the receptor sheet 115. Therefore, also a heat conduction time and a melted state of the receptor sheet 115 are required to be taken into consideration.

Therefore, even in the case where the sealing portion 131 causes the permanent deformation, the receptor sheet 115 and the sealing portion 131 are bonded to each other, so that the contact between the receptor sheet 115 and the sealing portion 131 can be ensured to eliminate the gap t1. Accordingly, it becomes possible to seal the gap h2 shown in (b) of FIG. 31. Further, even when the C end portion seal member 126*a* is moved by rotation of the image bearing member 121, the welded portion 130 is formed and therefore the sealing portion 131 is moved by the movement of the C end portion seal member 126*a*, so that also an effect such that the gap h1 as shown in (b) of FIG. 31 is not generated is obtained. Further, in the case where the elastomer member 110 and the sealing portion 131 are integrally molded, it is possible to prevent generation of a gap due to a stepped portion or the like therebetween, so that the above-described effects can be obtained with reliability. Incidentally, a similar constitution is employed with respect to also the C end portion seal member 126*b* (not shown) in an opposite side. Further, also at the sealing portion by the D end portion seal member, it is possible to employ a constitution similar to the constitution described above.

Further, as the urging jig 45, a member having a rigidity such that it can press an entire contact surface between the receptor sheet 15 and the sheet member mounting surface 24*d* of the elastomer member 10 formed on the cleaning container 24 by molding may preferably be used. Specifically, acrylic resin, glass and the like may preferably be used.

Further, the cleaning container 24 on which the elastomer member 10 having tire sheet member mounting surface 24*d* is formed by molding is formed of the resin material, so that when the receptor sheet 15 is mounted, the sheet member mounting surface 24*d* is curved to cause some unevenness or deformation in some cases. Further, in some cases, the position of the receptor sheet 15 relative to the cleaning container 24 is shifted. Therefore, in this embodiment, the urging jig 45 was provided with an elastic urging member 47. By the urging member 47, the receptor sheet 15 is elastically urged toward the cleaning container 24 to be temporarily positioned, so that an adhesive property between the receptor sheet 15 and the sheet member mounting surface 24*d* can be improved. Further, positional deviation of the receptor sheet 15 can be prevented. Specifically, as the urging jig 45, a member including an acrylic member 46 as a rigid member and a 5 mm-thick silicone rubber member (urging member) 47 as an elastic member which are bonded with a transparent double-side tape was used. Incidentally, after the receptor sheet 15 is welded on the elastomer member 10 and then the urging jig 45 is removed, the deformation of the elastomer member 10 is eliminated, so that the receptor sheet 15 is spaced from the surface 49.

Further, as a near infrared ray irradiation device, a device ("FD200" (wavelength: 960 nm), mfd. by FIFE DEVICE Co., Ltd.) was used. A longitudinal scanning speed of the near infrared, ray irradiation device was 50 mm/sec, an output was 20 W, and a spot diameter on the elastomer member surface was 1.5 mm. Further, an energy density at the surface of the elastomer member 10 was 0.22 J/mm$^2$. Further, as the elastomer member 10, a member prepared by incorporating 0.5 to 12.0 wt, parts of carbon black into 100 wt. parts of the styrene-based elastomer resin material, was used.

The above-described bonding method between the receptor sheet 15 and the elastomer member 10 formed on the cleaning container 24 by molding can also be applied to welding between the blow off preventing sheet 16 and the elastomer member 11 formed on the developing container 71 by molding. Similarly, the bonding method is also applicable to bonding between the charging roller cleaner 17 and the elastomer member 12 formed on the cleaning container 24 by molding. Further, the bonding method is also applicable to welding between the scattering preventing sheet 16 and the elastomer member 13 formed on the developing container 71 by molding. Further, in thin embodiment, the receptor sheet 15 having the light transmittance of 65% or less may also be weldable. Further, as a method other than the welding (bonding) method in this embodiment, the elastomer member 10 and the receptor sheet 15 may also be welded by heat seal or the like. Incidentally, by the heat seal or the like, heat cannot be applied to only a bonded interface between the receptor sheet 15 and the elastomer member 10 but is conducted (applied) from an upper surface of she receptor sheet 15. Therefore, there is also a need to sake a heat conduction time and melting of the receptor sheet 15 into consideration.

In the case of the conventional method using the double-side tape as the adhesive process cartridge, after left-standing in the high temperature environment, deviation is generated at the bonded interface between the double-side tape and each of the sheet members such as the receptor sheet 15, so that the initial tension of the sheet member is attenuated. In this embodiment, the sheet member and each of the elastomer members 10 to 13 are bonded by the welding. Further, by making an elastic modulus of the elastomer member smaller than that of the frame such as the cleaning container 24 or the developing container 71, an amount, of permanent deformation of the elastomer member alter being left standing in the high temperature environment can be made small. Further, after the left-standing in the high temperature environment, deviations at a bonded interface between the sheet member and the elastomer member and at a bonded interface between the frame and the elastomer member are not generated and therefore the initial tension of the sheet member can be maintained.

The elastomer member formed on the frame by molding in this embodiment specifically has a shape as shown in FIG. 24 such that dimensions thereof are h=0.6 to 0.8 mm, i=0.1 to 0.3 mm, j=1.0 mm, k=0.3 mm and r=1.6 mm. Here, h is a free length of the elastomer member during molding, i is an elastomer member melting margin, j is an elastomer member molding width (upper side), k is an entering amount of the elastomer member entering the container, and r is an elastomer member molding width (bottom side). In such a dimensional constitution, a section modulus is about 0.25. Further, the material for forming the frame is HIPS (high-impact polystyrene) and its linear expansion coefficient is 0.000087 (1/° C.), and an elastic modulus of the material is 2.38 dps. The material for the sheet member is polyester and is 38 μm in thickness, 0.000015 (1/° C.) in linear expansion coefficient and 4.5 GPa in elastic modulus. That is, a degree of temperature change of the frame is about 5.8 times that of the sheet member. Therefore, when a left-standing environment is changed from normal temperature (e.g., 23° C.) to 50° C. a load corresponding to a difference in elongation between the frame and the sheet member is applied to the elastomer member sandwiched between the frame and the sheet member. This load is a difference in displacement between the frame and, the sheet member in the 50° C. environment. In the case where the displacement under the 50° C. environment is calculated, the elongation amount of the frame (having a full length of 220 mm equal to that of the sheet member) is 0.52 mm and the elongation amount of the sheet member is 0.09 mm, so that the elongation difference Δ is 0.43 mm.

As described above, by making the elastic modulus of the elastomer member being a range, of 2.5 MPa or more and 10 MPa or less, which is smaller than the elastic modulus of the sheet member, it is possible to decrease the amount of permanent deformation of the elastomer member, due to the load under the 50° C. environment, at the time when the ambient temperature is restored to normal temperature. Further, each of the bonded, interface between the frame and the elastomer member and the bonded interface between the sheet member and the elastomer member is formed by molding and welding and therefore no deviation is generated, so that the initial tension of the sheet member can be maintained. As a result, it becomes possible to prevent the waving of the sheet member.

As described above, according to this embodiment, the elastomer member is directly formed on the frame by molding and therefore it is possible to effect assembling with a higher degree of accuracy than that in the case of the double-side tape. Further, the deviation of the bonded interface, generated in the case of using she double-side rape, between the frame and the double-side tape after being left standing in the high temperature environment can be eliminated. Further, by bonding the sheet member and the elastomer member to each other by welding, it is possible to eliminate the deviation of the bonded interface, generated in the case of using the double-side tape as the adhesive member, between tire sheet member and the double-side tape after being left standing in the nigh temperature environment. Further, by making the elastic modulus of the elastomer member smaller than the elastic modulus of the frame or the sheet member, the amount of permanent deformation of the elastomer member after being left standing in the high temperature environment can be made small. Further, there are no deviations of the bonded interface between the frame and the elastomer member and the bonded interface between the sheet member and the elastomer member, and therefore the initial tension of the sheet member can be maintained, so that the waving of the sheet member can be prevented.

Further, in the case of the conventional constitution using the double-side tape as the adhesive portion, the resin material such as the hot melt was injected so as not to generate gaps each between respective members. Specifically the gaps are generated between the receptor sheet 115 or the blowoff preventing sheet 116 (which are used as the sheet member) and the cleaning container 124 or the developing container 171 (which are used as the frame), and between the frame and the C end portion seal member 126*a* (126*b*) or the D end portion, seal member. However, by using the constitution in this embodiment, as described above, it becomes possible to more effectively seal each of the gap between the sheet member and the frame and the gap between the frame and the end portion seal member.

According to the present invention, it becomes possible to reliably prevent leaking-out of the toner from between the end portion seal member of the unit and the sheet member contacting the rotatable member.

While the invention has been described with reference to tire structures disclosed herein, it is not confined to the details set forth and this application is intended to cover such modifications or changes as may come within the purpose of the improvements or the scope of the following claims.

This application claims priority from Japanese Patent Applications Nos. 196377/2012 filed Sep. 6, 2012 and 170576/72013 filed Aug. 20, 2013, which are hereby incorporated by reference.

What is claimed:

1. A unit for use with an image forming apparatus, said unit comprising:

a frame;

a developer accommodating portion, constituted by said frame, for accommodating developer;

a sheet member, contacted to a rotatable member and provided on said frame along a longitudinal direction of the rotatable member, for preventing the developer from leaking out from between said frame and the rotatable member;

a first end portion seal member for preventing, at a longitudinal end portion, the developer from leaking out from between said frame and the rotatable member; and a second end portion seal member for preventing the developer from leaking out from among said first end portion seal member, said sheet member, and said frame, wherein said second end portion seal member is formed by injecting a resin material on said frame so as to contact with said first end portion seal member in a state in which said second end portion seal member is flexed.

2. A unit according to claim 1, further comprising a resin member for fixing said sheet member on said frame, wherein said resin member is formed by injecting a resin material on said frame and is mounted on said frame by welding of said sheet member.

3. A unit according to claim 2, wherein said resin member is formed of the resin material having an elastic modulus smaller than the elastic modulus of said frame.

4. A unit according to claim 2, wherein said second end portion seal member is integrally molded with said resin member.

5. A unit according to claim 1, wherein said second end portion seal member is molded at a recessed portion provided in said frame.

6. A unit according to claim 1, wherein said second end portion seal member has an elastic modulus smaller than an elastic modulus of said sheet member.

7. A unit according to claim 1, wherein said sheet member is welded on said second end portion seal member by heating.

8. A unit according to claim 1, wherein said second end portion seal member contains carbon black capable of absorbing near infrared ray, wherein said sheet member is capable of passing the near infrared ray therethrough, and wherein said second end portion seal member generates heat by absorbing the infrared ray to weld said sheet member.

9. A unit according to claim 1, wherein said first end portion seal member is constituted by an elastic member or fibers.

10. A unit according to claim 1, wherein said second end portion seal member includes a contact portion, having a bifurcated shape, contacted to said first end portion seal member.

11. A unit according to claim 1, wherein said first end portion seal member is inclined and projected from said frame with respect to the longitudinal direction.

12. A unit according to claim 1, wherein the rotatable member is an image bearing member, and wherein said developer accommodating portion accommodates the developer removed from the image bearing member.

13. A unit according to claim 12, which is a cartridge detachably mountable to a main assembly of the image forming apparatus.

14. A unit according to claim 1, wherein the rotatable member is a developer icarrying member for developing a latent image formed on an image bearing member, wherein said developer accommodating portion accommodates the developer used for developing the latent image.

15. A unit according to claim 14, which is a cartridge detachably mountable to a main assembly of the image forming apparatus.

16. A unit according to claim 1, wherein said second end portion seal member is flexed toward the outside of said frame.

17. A unit according to claim 1, wherein said second end portion seal member is formed so as to contact said first end portion seal member and said sheet member in a state in which said second end portion seal member is flexed.

18. An image forming apparatus for forming an image on a recording material, said image forming apparatus comprising:

a frame;

a developer accommodating portion, constituted by said frame, for accommodating developer;

a sheet member, contacted to a rotatable member and provided on said frame along a longitudinal direction of said rotatable member, for preventing the developer from leaking out from between said frame and said rotatable member;

a first end portion seal member for preventing, at a longitudinal end portion, the developer from leaking out from between said frame and said rotatable member; and a second end portion seal member for preventing the developer from leaking out from among said first end portion seal member, said sheet member and said frame, wherein said second end portion seal member is formed by injecting a resin material on said frame so as to contact with said first end portion seal member in a state in which said second end portion seal member is flexed.

19. An image forming apparatus according to claim 18, further comprising a resin member for fixing said sheet member on said frame, wherein said resin member is formed by injecting a resin material on said frame and is mounted on said frame by welding of said sheet member.

20. An image forming apparatus according to claim 19, wherein said resin member is formed of the resin material having an elastic modulus smaller than the elastic modulus of said frame.

21. An image forming apparatus according to claim 19, wherein said second end portion seal member is integrally molded with said resin member.

22. An image forming apparatus according to claim 18, wherein said second end portion seal member is molded at a recessed portion provided in said frame.

23. An image forming apparatus according to claim 18, wherein said second end portion seal member has an elastic modulus smaller than an elastic modulus of said sheet member.

24. An image forming apparatus according to claim 18, wherein said sheet member is welded on said second end portion seal member by heating.

25. An image forming apparatus according to claim 16, wherein said second end portion seal member contains carbon black capable of absorbing near infrared ray, wherein said sheet member is capable of passing the near infrared ray therethrough, and wherein said second end portion seal member generates heat by absorbing the infrared ray to weld said sheet member.

26. An image forming apparatus according to claim 18, wherein said first end portion seal member is constituted by an elastic member or fibers.

27. An image forming apparatus according to claim 18, wherein said second end portion seal member includes a contact portion, having a bifurcated shape, contacted to said first end portion seal member.

28. An image forming apparatus according to claim 18, wherein said first end portion seal member is inclined and projected from said frame with respect to the longitudinal direction.

29. An image forming apparatus according to claim 18, wherein said second end portion seal member is flexed toward the outside of said frame.

30. An image forming apparatus according to claim 18, wherein said second end portion seal member is formed so as to contact with said first end portion seal member and said sheet member in a state in which said second end portion seal member is flexed.

* * * * *